US008095028B2

(12) United States Patent
Ehara et al.

(10) Patent No.: US 8,095,028 B2
(45) Date of Patent: Jan. 10, 2012

(54) IMAGE FORMING APPARATUS AND IMAGE FORMING METHOD

(75) Inventors: Yasuhisa Ehara, Kanagawa (JP); Noriaki Funamoto, Tokyo (JP); Jun Yasuda, Chiba (JP); Tetsuji Nishikawa, Tokyo (JP); Yasuhiro Maehata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 411 days.

(21) Appl. No.: 12/457,737

(22) Filed: Jun. 19, 2009

(65) Prior Publication Data

US 2009/0317109 A1 Dec. 24, 2009

(30) Foreign Application Priority Data

Jun. 24, 2008 (JP) ..... 2008-164970

(51) Int. Cl.
*G03G 15/16* (2006.01)
*G03G 15/00* (2006.01)
*G03G 15/01* (2006.01)

(52) U.S. Cl. ..... 399/66; 399/167; 399/301; 399/302; 399/303

(58) Field of Classification Search ..... 399/66, 399/167, 301, 302, 303
See application file for complete search history.

(56) References Cited

U.S. PATENT DOCUMENTS

| | | | | |
|---|---|---|---|---|
| 7,373,097 | B2 | 5/2008 | Ehara | |
| 7,440,714 | B2 * | 10/2008 | Kosako | 399/167 |
| 2006/0039722 | A1 | 2/2006 | Ehara | |
| 2007/0097465 | A1 | 5/2007 | Kobayashi et al. | |
| 2007/0110477 | A1 | 5/2007 | Handa et al. | |
| 2007/0196132 | A1 | 8/2007 | Kobayashi et al. | |
| 2007/0253736 | A1 | 11/2007 | Ehara et al. | |
| 2008/0131168 | A1 | 6/2008 | Ehara et al. | |
| 2008/0166153 | A1 | 7/2008 | Ehara et al. | |
| 2008/0213000 | A1 | 9/2008 | Funamoto et al. | |
| 2009/0123182 | A1 * | 5/2009 | Sasamoto et al. | 399/167 |

FOREIGN PATENT DOCUMENTS

| | | |
|---|---|---|
| JP | 2000-231305 | 8/2000 |
| JP | 3186610 | 5/2001 |
| JP | 2003-194181 | 7/2003 |
| JP | 2007-034025 | 2/2007 |

OTHER PUBLICATIONS

Abstract of JP 10-078734 published Mar. 24, 1998.

* cited by examiner

*Primary Examiner* — David Gray
*Assistant Examiner* — Joseph Wong
(74) *Attorney, Agent, or Firm* — Harness, Dickey & Pierce, P.L.C.

(57) ABSTRACT

A driving motor for a color black is shared between a photosensitive body for the color black and a driving roller that drives an intermediate transfer belt not shown. Furthermore, a driving motor for colors yellow, magenta, and cyan is shared between photosensitive bodies for the colors yellow, magenta, and cyan. Driving of the driving motor for the colors yellow, magenta, and cyan is controlled based on a first waveform as a speed fluctuation waveform of the photosensitive body for the color black obtained when the driving motor for the color black is driven at a predetermined speed and second waveforms as speed fluctuation waveforms of the photosensitive bodies for the colors yellow, magenta, and cyan obtained when the driving motor for the colors yellow, magenta, and cyan is driven at a predetermined speed.

7 Claims, 22 Drawing Sheets

IMAGE FORMING APPARATUS AND IMAGE FORMING METHOD

BACKGROUND OF THE INVENTION

1. Field of the Invention

The present invention relates to an image forming apparatus and an image forming method for transferring visible images formed on plural image carriers to the endlessly-moving front surface of an endless movement body or a recording member held on the front surface thereof so as to be superimposed one on another.

2. Description of the Related Art

A known image forming apparatus of this type is one described in Patent Document 1. This image forming apparatus has plural photosensitive bodies serving as image carriers and a belt member serving as an endless movement body that performs an endless movement to successively pass through positions facing the photosensitive bodies. In the image forming apparatus, toner images of different colors are formed on the front surfaces of the respective photosensitive bodies and then transferred to a recording paper held on the front surface of the belt member so as to be superimposed one on another through an electrophotographic process. With the superimposition of the toner images, a multicolor toner image is formed on the front surface of the recording paper.

In the image forming apparatus that forms the multicolor toner image in this manner, displacements in the superimposition of the dots of respective colors may occur due to the off-centering of a photosensitive-body gear fixed to the rotary shaft of a photosensitive body. Specifically, when the maximum-diameter part of the photosensitive-body gear, at which a length from the rotary shaft to a gear tooth tip is the longest with respect to the off-centering of the photosensitive-body gear, is meshed with a driving gear, the linear speed of the photosensitive body per rotation becomes the slowest. Conversely, when the minimum-diameter part of the photosensitive-body gear, at which the distance from the rotary shaft to the gear tooth tip is the shortest with respect to the off-centering of the photosensitive-body gear, is meshed with the driving gear, the linear speed of the photosensitive body per rotation becomes the fastest. Since the maximum- and minimum-diameter parts of the photosensitive-body gear are symmetrical about a point by 180° relative to the rotary shaft, the linear speed of the photosensitive body has a fluctuation characteristic in which a sine curve for one cycle is displayed per cycle of the gear. Among mountain parts and valley parts created when a center line is drawn between the maximum and minimum values of the sine curve, the valley parts of the sine curve indicate that the linear speed of the photosensitive body becomes slower than its original speed (the value of the center line). Thus, dots on the photosensitive body are transferred to a recording paper moving faster than the photosensitive body in a state of being more expanded than usual in a belt movement direction. On the other hand, the mountain parts of the sine curve indicate that the linear speed of the photosensitive body becomes faster than its original speed. Thus, the dots on the photosensitive body are transferred to the recording paper moving slower than the photosensitive body in a state of being more contracted than usual in the belt movement direction. The dots of the respective colors are thus separately expanded and contracted to cause the displacements in the superimposition of the dots of the respective colors.

The image forming apparatus described in Patent Document 1 prevents the displacements in the superimposition of the dots of the respective colors in the following manner. In other words, a pattern image for detecting a speed fluctuation waveform is first formed on the belt member at a predetermined timing. This pattern image is composed of patch-like toner images of the respective colors arranged in a belt-surface movement direction in a predetermined order. If no speed fluctuation occurs in the photosensitive bodies for the respective colors, the toner images are arranged at even intervals. On the other hand, if any speed fluctuation occurs in the photosensitive bodies for the respective colors, the toner images are not arranged on the belt member at even intervals and differences between the intervals reflect the speed fluctuation of the photosensitive bodies for the respective colors. The differences between the intervals are detected based on an output from a photosensor that detects the toner images for the respective colors, whereby the sine-curve-like speed fluctuation waveform is detected for each of the photosensitive bodies for the respective colors. Then, the driving speed variation pattern of each of the photosensitive bodies capable of canceling the sine-curve-like speed fluctuation waveform is determined and stored in a data storage unit. Subsequently, when a print job is performed, reference timing in a one-rotation cycle is recognized for each of the photosensitive bodies for the respective colors based on an output from an encoder fixed to each of the rotary shafts of the photosensitive bodies for the respective colors. Then, the driving speed of each of plural driving motors that separately drive the photosensitive bodies for the respective colors is finely adjusted based on the reference timing and the driving speed fluctuation pattern stored in advance. With this fine adjustment of the driving speed, the speed fluctuations of the photosensitive bodies for the respective colors are reduced, so that the displacements in the superimposition of the dots of the respective colors can be prevented.

Note that in addition to the displacements in the superimposition of the dots due to the speed fluctuations of the photosensitive bodies, the image forming apparatus described in Patent Document 1 detects displacements in the superimposition of the dots due to the speed fluctuation of a driving roller that drives the belt member, or the like. For this reason, the above-described pattern image is formed. However, when only the speed fluctuations of the photosensitive bodies are detected to control the driving motor, the formation of the pattern image can be omitted. This is because the speed fluctuation waveforms of the photosensitive bodies can be detected based on the outputs from the encoders fixed to the rotary shafts of the photosensitive bodies.

The image forming apparatus described in Patent Document 1 refers to the displacements in the superimposition of the dots on the recording paper conveyed in a state of being held on the front surface of the belt member, but a similar displacement in the superimposition of the dots may occur in an image forming apparatus having the following configuration. In other words, the image forming apparatus is configured to transfer the toner images formed on the photosensitive bodies for the respective colors to an intermediate transfer belt serving as the belt member so as to be superimposed one on another and then transferring them to the recording paper in a collective manner.

On the other hand, Patent Document 2 describes an image forming apparatus that reduces the displacements in the superimposition of the dots of the respective colors by matching the phases of the speed fluctuation waveforms of the photosensitive bodies for the respective colors to each other. Specifically, in this image forming apparatus, the arrangement pitches of the photosensitive bodies are set to be an integral multiple of the circumferential length of the photosensitive bodies. Under this setting, the photosensitive-body gears are rotated by an integral number while the belt member is moved from one position facing any one of the photosensitive bodies to another position facing the adjacent photosensitive body. Therefore, when the photosensitive bodies are rotated in a state in which rotational phases at the maximum- and minimum-diameter parts of the photosensitive-body gears are matched to each other, the two adjacent photosensitive bodies transfer the following dots to the recording paper so as to be superimposed one on another. In other words, the dots entering a transfer position when the photosensitive bodies are driven at the maximum linear speed per rotation and those entering the transfer position when the photosensitive bodies are driven at the minimum linear speed per rotation are transferred to the recording paper. In such the superimposition of the dots, the dots transferred in a state of being more expanded than usual and those transferred in a state of being more contracted than usual due to the speed fluctuations of the photosensitive bodies are superimposed one on another, thereby making it possible to prevent the displacements in the superimposition of the dots. To this end, the image forming apparatus described in Patent Document 2 has plural photosensors that detect marks provided at the maximum- and minimum-diameter parts of the photosensitive bodies at predetermined positions. Furthermore, the image forming apparatus controls the driving of the driving motors for the respective colors so that timings for detecting the marks with the photosensors are synchronized with each other.

Patent Document 1: JP-B2-3186610

Patent Document 2: JP-A-2003-194181

Meanwhile, since reduction of manufacturing costs for apparatuses has been in demand recently, it is desired in some cases that the driving motor for driving the photosensitive body be also used as a driving source for members other than the corresponding photosensitive body. For example, it is desired in some cases that, regardless of a monochrome mode and a color mode, the driving motor for black to be driven among plural of the driving motors corresponding to the photosensitive bodies for the respective colors be used as a driving source for the belt member. In this case, when the driving speed of the driving motor for black is finely adjusted based on the predetermined driving speed variation pattern to cancel the speed fluctuation due to the off-centering of the photosensitive body for black, the fluctuation of the speed of the belt member occurs. Accordingly, processing for finely adjusting the driving speed of the driving motor based on the driving speed variation pattern as described in Patent Document 1 is not suitable. Conversely, when performing the processing for matching the rotational phases of the photosensitive-body gears for the respective colors to each other as described in Patent Document 2, the image forming apparatus can prevent the displacements in the superimposition of the dots of the respective colors without causing the speed fluctuation of the belt member described above.

However, while high quality has been in demand in recent technologies, the displacements in the superimposition of the dots of the respective colors exceeding a tolerance level may remain only if the rotational phases of the photosensitive gears for the respective colors are matched to each other. Specifically, the displacements in the superimposition of the dots of the respective colors cannot be eliminated only with the superimposition of the rotational phases of the photosensitive-body gears for the respective colors. It is assumed that speed fluctuation occurs in the photosensitive bodies for the respective colors as shown in FIG. 1 when the toner images of yellow (Y), magenta (M), cyan (C), and black (K) are formed on the separate photosensitive bodies and then transferred to the recording paper. In an example shown in FIG. 1, the speed fluctuation of the photosensitive body for yellow among the four photosensitive bodies corresponding to the respective colors is the greatest. Furthermore, the speed fluctuation of the photosensitive body for cyan is the smallest. As shown in FIG. 1, when the rotations of the respective photosensitive bodies are controlled so that the speed variation waveforms of the respective photosensitive bodies are matched to each other, the dots transferred at the maximum linear speed and those transferred at the minimum linear speed of the photosensitive bodies for the respective colors are superimposed one on another. As a result, the amounts of the displacements in the superimposition of the dots can be reduced. However, as shown in FIG. 2, the displacement in the superimposition of the dots corresponding to the difference between the amplitude of the speed variation waveform of the photosensitive body for yellow having the greatest speed fluctuation and that of the speed fluctuation waveform of the photosensitive body for cyan having the smallest speed fluctuation among the four photosensitive bodies remains. When the difference between the amplitudes is relatively large, the amount of the displacement in the superimposition of the dots exceeds a tolerance level.

SUMMARY OF THE INVENTION

The present invention has been made in view of the above circumstances and may provide an image forming apparatus and an image forming method. Specifically, the present invention may provide the image forming apparatus capable of reducing manufacturing costs with the shared use of a driving source between an image carrier and other members and keeping displacements in the superimposition of dots at a tolerance level.

According to an embodiment of the present invention, there is provided an image forming apparatus including plural image carriers each having a visible image carried on a rotating surface thereof; a first driving source that is a driving source for only any one of the image carriers; a second driving source that is a driving source for another image carrier; a rotation detection unit that separately detects whether the image carrier driven by the first driving source and another image carrier driven by the second driving source have a predetermined rotational angle; an endless movement body that causes a front surface thereof to be endlessly moved; a transfer unit that transfers the visible images formed on front surfaces of the image carriers to the front surface of the endless movement body or a recording member held on the front surface of the endless movement body so as to be superimposed one on another; and a control unit that controls driving of the first and second driving sources based on an output from the rotation detection unit. The image forming apparatus uses the first driving source as a shared driving source between the image carrier and a predetermined member other than a driving transmission unit for driving the image carrier. A waveform recognition unit is provided that recognizes a first waveform as a waveform of a first speed fluctuation and a second waveform as a waveform of a second speed fluctuation based on a result obtained by detecting the first speed fluctuation per rotation of the image carrier driven by a driving force of the first driving source driven at a predetermined speed and the second speed fluctuation per rotation of another image carrier driven by a driving force of the second driving source driven at a predetermined speed. The control unit is configured to recognize a reference timing per rotation of the image carrier driven by the first driving source and a reference timing per rotation of another image carrier driven by the second driving source based on the output from the rotation detection unit and control the driving of the second driving source based on the reference timings and the first and second waveforms recognized by the waveform recognition unit, thereby matching a phase and an amplitude of the second waveform of another image carrier driven by the second driving source to a phase and an amplitude of the first waveform of the image carrier driven by the driving force of the first driving source driven at the predetermined speed.

Other objects, features and advantages of the present invention will become more apparent from the following detailed description when read in conjunction with the accompanying drawings.

DETAILED DESCRIPTION OF THE PREFERRED EMBODIMENTS

Next, a description is made of an embodiment of an electrophotographic printer (hereinafter simply referred to as a printer) as an image forming apparatus to which the present invention is applied.

Figure 3:
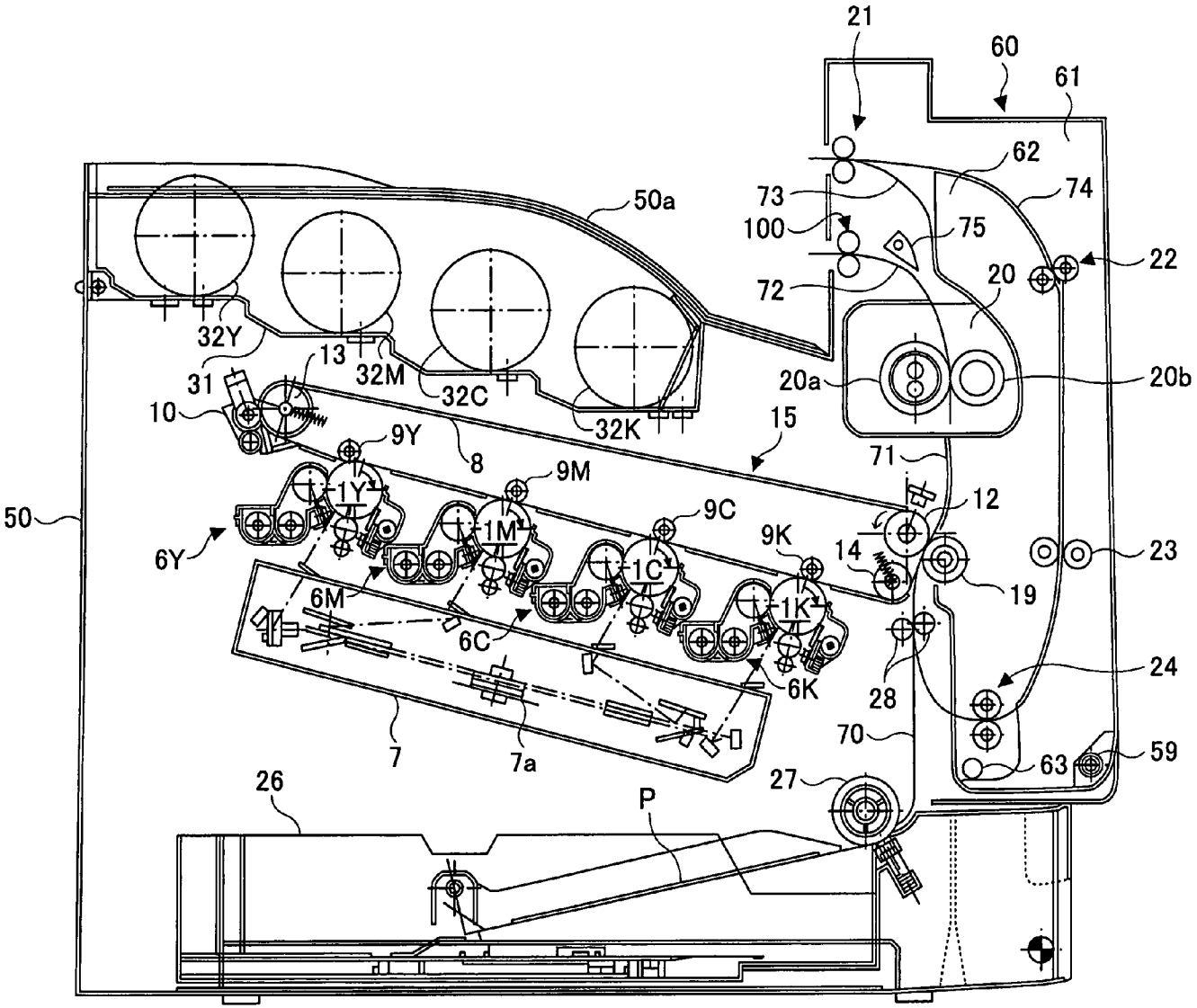
FIG. 3 is a schematic configuration diagram showing a printer according to an embodiment.
Figure 4:
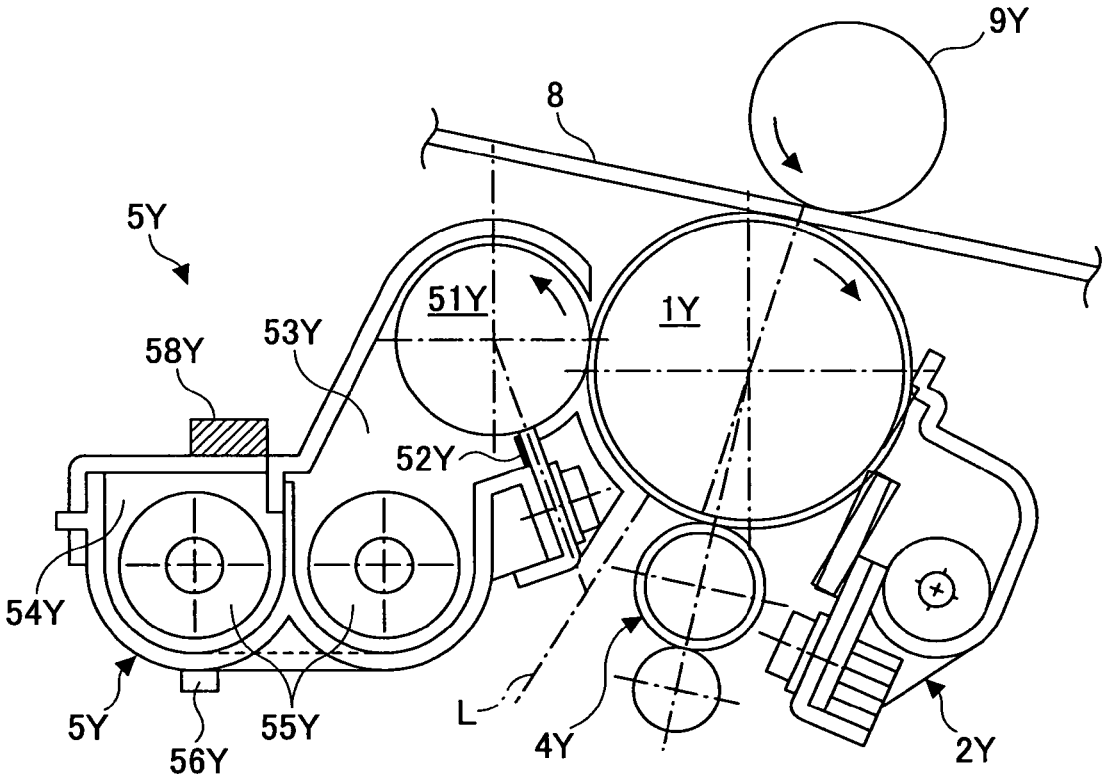
FIG. 4 is an enlarged configuration diagram showing a processing unit for the color Y and the circumferential configuration of the processing unit in the printer.

First, the basic configuration of the printer is described. FIG. 3 is a schematic configuration diagram showing the printer according to the embodiment. In FIG. 3, the printer according to the embodiment has four processing units 6Y, 6M, 6C, and 6K that generate toner images of yellow, magenta, cyan, and black (hereinafter referred to as Y, M, C, and K). These processing units use Y, M, C, and K toner, respectively, as image forming materials, but they have the same configuration and are replaced when their service life intervals have reached their ends. For example, as shown in FIG. 4, the processing unit 6Y that generates a Y-toner image has a drum-like photosensitive body 1Y, a drum cleaning unit 2Y, an electrostatic elimination unit (not shown), a charging unit 4Y, a development unit 5Y, and the like. The processing unit 6Y serving as an image forming unit is detachable from a printer main body, whereby consumable parts can be collectively replaced.

The charging unit 4Y uniformly charges the front surface of the photosensitive body 1Y rotated in a clockwise direction in FIG. 4 by a driving unit (not shown). The front surface of the uniformly-charged photosensitive body 1Y serving as an image carrier is exposure-scanned by a laser beam L to have a Y electrostatic latent image carried on it. The Y electrostatic latent image is developed into the Y-toner image by the development unit 5Y that uses a Y developing agent containing the Y toner and a magnetic carrier. The Y-toner image is then intermediately transferred to an intermediate transfer belt 8 described below. The drum cleaning unit 2Y eliminates toner remaining at the front surface of the photosensitive body 1Y that has been subjected to the intermediate transfer process. Furthermore, the electrostatic elimination unit eliminates charges remaining at the photosensitive body 1Y that has been cleaned by the drum cleaning unit 2Y. With this electrostatic elimination, the front surface of the photosensitive body 1Y is initialized to be prepared for the next image formation. Also in the processing units 6M, 6C, and 6K, M, C, and K toner images are formed on photosensitive bodies 1M, 1C, and 1K, respectively, and then intermediately transferred to the intermediate transfer belt 8.

The development unit 5Y has a development roller 51Y provided so as to be partially exposed from an opening of its casing. In addition, the development unit 5Y has two conveyance screws 55Y provided parallel to each other, a doctor blade 52Y, a toner density sensor (hereinafter referred to as a T sensor) 56Y, and the like.

Inside the casing of the development unit 5Y, the Y developing agent (not shown) containing the magnetic carrier and the Y toner is accommodated. The Y developing agent is friction-charged while being stirred and conveyed by the two conveyance screws 55Y and then carried on the front surface of the development roller 51Y. Next, after its layer thickness is controlled by the doctor blade 52Y, the Y developing agent is conveyed to a development region facing the photosensitive body 1Y. At the development region, the Y toner is attached to the electrostatic latent image on the photosensitive body 1Y. Thus, the Y-toner image is formed on the photosensitive body 1Y. In the development unit 5Y, the Y development agent whose Y toner has been consumed by development is returned to the casing along with the rotation of the development roller 51Y.

A partition wall is provided between the two conveyance screws 55Y. With this partition wall, a first supply unit 53Y that accommodates the development roller 51Y, the conveyance screw 55Y on the right side in FIG. 4, and the like and a second supply unit 54Y that accommodates the conveyance screw 55Y on the left side in FIG. 4 are separately provided in the casing. The conveyance screw 55Y on the right side in FIG. 4 is rotated and driven by a driving unit (not shown) and conveys the Y developing agent in the first supply unit 53Y from a near side to a back side in FIG. 4 and supplies it the development roller 51Y. The Y developing agent, which is conveyed in the vicinity of the end part of the first supply unit 53Y by the conveyance screw 55Y on the right side in FIG. 4, passes through an opening part (not shown) provided in the partition wall and enters the second supply unit 54Y. The conveyance screw 55Y on the left side in FIG. 4 is rotated and driven by a driving unit (not shown) and conveys the Y developing agent conveyed from the first supply unit 53Y in a direction opposite to the direction to which the conveyance screw 55Y on the right side in FIG. 4 conveys the Y developing agent. The Y developing agent, which is conveyed in the vicinity of the end part of the second supply unit 54Y by the conveyance screw 55Y on the left side in FIG. 4, passes through the other opening part (not shown) provided in the partition wall and is returned to the first supply unit 53Y.

The T sensor 56Y composed of a permeability sensor is provided at the bottom wall of the second supply unit 54Y and outputs the voltage of a value corresponding to the permeability of the Y developing agent that passes through a position above the T sensor 56Y. Since the permeability of a two-component developing agent containing toner and a magnetic carrier shows a good mutual relationship with a toner density, the T sensor 56Y outputs the voltage of a value corresponding to a Y-toner density. The value of the output voltage is transmitted to a control unit (not shown). The control unit has a RAM storing Vtref for the color Y as the target value of the output voltage from the T sensor 56Y. The RAM also stores data of Vtref for the color M, Vtref for the color C, and Vrtref for the color K as the target values of output voltages from T sensors (not shown) provided in other development units. Vtref for the color Y is used for controlling the driving of a Y toner conveyance unit described below. Specifically, the control unit controls the driving of the Y toner conveyance unit (not shown) to replenish the second supply unit 54Y with the Y toner so that the value of the output voltage from the T sensor 56Y approximates Vtref for the color Y. With this replenishment, the Y toner density of the Y developing agent in the development unit 5Y is kept in a predetermined range. The development units of other processing units also perform the same toner replenishment control using M, C, and K toner conveyance units.

In FIG. 3, an optical writing unit 7 is provided below the processing units 6Y, 6M, 6C, and 6K. The optical writing unit 7 serving as a latent image forming unit scans the photosensitive bodies in the processing units 6Y, 6M, 6C, and 6K by using the laser beams L emitted based on image information. With this scanning operation, Y, M, C, and K electrostatic latent images are formed on the photosensitive bodies 1Y, 1M, 1C, and 1K. Note that the optical writing unit 7 causes the laser beams L emitted from an optical source to be reflected by a polygon mirror rotated and driven by a motor and deflected in a main scanning direction, and then irradiates the photosensitive bodies with the laser beams L through plural optical lenses and mirrors.

In FIG. 3, a paper accommodation unit having a paper feeing cassette 26, a paper feeding roller 27 incorporated in the paper feeding cassette 26, and the like are provided below the optical writing unit 7. In the paper feeding cassette 26, plural transfer papers P serving as paper-like recording members are accommodated in a stacked manner and the paper feeding roller 27 is brought into contact with the topmost transfer paper P. When the paper feeding roller 27 is rotated in a counterclockwise direction in FIG. 3 by a driving unit (not shown), the topmost transfer paper P is fed to a paper feeding path 70.

In the vicinity of the terminal end of the paper feeding path 70, a pair of resist rollers 28 is provided. The pair of the resist rollers 28 is rotated to sandwich the transfer paper P but temporarily stopped immediately when the transfer paper P is sandwiched between the rollers 28. Then, the pair of the resist rollers 28 feeds the transfer paper P to a secondary transfer nip described below at an appropriate timing.

Above the processing units 6Y, 6M, 6C, and 6K in FIG. 3, a transfer unit 15 serving as an endless movement body is provided that performs the endless movement of an intermediate transfer belt 8 serving as an intermediate transfer body in a state in which the intermediate transfer belt 8 is stretched. In addition to the intermediate transfer belt 8, the transfer unit 15 has a secondary transfer bias roller 19, a cleaning unit 10, and the like. Moreover, the transfer unit 15 has four primary transfer bias rollers 9Y, 9M, 9C, and 9K, a driving roller 12, a cleaning backup roller 13, a tension roller 14, and the like. The intermediate transfer belt 8 performs the endless movement in the counterclockwise direction in FIG. 3 by the rotation drive of the driving roller 12 while being stretched by these seven rollers. The primary transfer bias rollers 9Y, 9M, 9C, and 9K sandwich the intermediate transfer belt 8 thus performing the endless movement between the primary transfer bias rollers 9Y, 9M, 9C, and 9K and photosensitive bodies 1Y, 1M, 1C, and 1K to form primary transfer nips between them. The primary transfer bias rollers 9Y, 9M, 9C, and 9K apply a transfer bias having a (e.g., positive) polarity opposite to that of toner to the rear surface (loop inner circumference surface) of the intermediate transfer belt 8. The rollers other than the primary transfer bias rollers 9Y, 9M, 9C, and 9K are all electrically grounded. In a process in which the intermediate transfer belt 8 successively passes through the primary transfer nips for the colors Y, M, C, and K along with its endless movement, the Y, M, C, and K toner images on the photosensitive bodies 1Y, 1M, 1C, and 1K are primarily transferred to the intermediate transfer belt 8 so as to be superimposed one on another. Thus, a four-color superimposed toner image (hereinafter referred to as a four-color toner image) is formed on the intermediate transfer belt 8.

The driving roller 12 sandwiches the intermediate transfer belt 8 between the driving roller 12 and the secondary transfer roller 19 to form the secondary transfer nip. The four-color toner image as a visible image formed on the intermediate transfer belt 8 is transferred to the transfer paper P at the secondary transfer nip. Then, the four-color toner image is combined with white color of the transfer paper P to form a full-color toner image. Remaining transfer toner that has not been transferred to the transfer paper P is attached to the intermediate transfer belt 8 that has passed through the secondary transfer nip. The remaining transfer toner is cleaned by the cleaning unit 10. The transfer paper P to which the four-color toner image is collectively secondarily transferred at the secondary transfer nip is fed to a fixation unit 20 via a conveyance path 71.

The fixation unit 20 forms a fixation nip with a fixation roller 20*a* having a heat generation source such as a halogen lamp inside it and a pressure roller 20*b* that rotates in contact with the fixation roller 20*a* at a predetermined pressure. The transfer paper P fed into the fixation unit 20 is sandwiched at the fixation nip so as to make its unfixed-toner-image carrying surface closely contact the fixation roller 20*a*. Then, the toner in the full-color toner image is softened by influences of heating and pressure. Thus, a full-color image is fixed.

The transfer paper P on which the full-color image is fixed by the fixation unit 20 is ejected from the fixation unit 20 and then approaches a branch point between a paper discharge path 72 and a pre-inversion conveyance path 73. A first switch claw 75 is provided at the branch point in a state in which it can swing. The movement path of the transfer paper P is switched when the first switch claw 75 is swung. Specifically, when the tip end of the claw 75 is moved in a direction close to the pre-inversion conveyance path 73, the movement path of the transfer paper P is directed to the paper discharge path 72. Furthermore, when the tip end of the claw 75 is moved in a direction away from the pre-inversion conveyance path 73, the movement path of the transfer paper P is directed to the pre-inversion conveyance path 73.

When the movement path directed to the paper discharge path 72 is selected by the first switch claw 75, the transfer paper P passes through the paper discharge path 72 via a pair of paper discharge rollers 100, is discharged outside the apparatus, and is stacked on a stack unit 50*a* provided at the top surface of a printer housing. On the other hand, when the movement path directed to the pre-inversion conveyance path 73 is selected by the first switch claw 75, the transfer paper P passes through the pre-inversion conveyance path 73 and enters a nip formed at a pair of inversion rollers 21. The pair of the inversion rollers 21 conveys the transfer paper P sandwiched between the inversion rollers 21 toward the stack unit 50*a* but reverses rotation immediately before the rear end of the transfer paper P enters the nip. Thus, the transfer paper P is conveyed in reverse, and the rear end of the transfer paper P enters an inversion conveyance path 74.

The inversion conveyance path 74 is formed into such a shape as to be extended from an upper side to a lower side in a vertical direction while being curved. In the inversion conveyance path 74, a pair of first inversion conveyance rollers 22, a pair of second inversion conveyance rollers 23, and a pair of third inversion conveyance rollers 24 are provided. The transfer paper P is conveyed while successively passing through nips formed at the pairs of the rollers and thus turned upside-down. The transfer paper P turned upside-down is returned to the paper feeding path 70 and fed to the secondary transfer nip again. Then, the transfer paper P enters the secondary transfer nip so as to make its non-image-carrying surface closely contact the intermediate transfer belt 8, and a second four-color toner image of the intermediate transfer belt 8 is collectively secondarily transferred to the non-image-carrying surface. Then, the transfer paper P passes through the conveyance path 71, the fixation unit 20, the paper discharge path 72, and the pair of the paper discharge rollers 100 and is stacked on the stack unit 50*a* outside the apparatus. With this inversion conveyance, the full-color images are formed on both surfaces of the transfer paper P.

A bottle support unit 31 is provided between the transfer unit 15 and the stack unit 50*a* positioned above the transfer unit 15. In the bottle support unit 31, toner bottles 32Y, 32M, 32C, and 32K serving as toner accommodation units that accommodate the Y, M, C, and K toner are installed. The toner bottles 32Y, 32M, 32C, and 32K are provided so as to be arranged at a slightly oblique angle to each other and set in height in the order of the colors Y, M, C, and K. The Y, M, C, and K toner in the toner bottles 32Y, 32M, 32C, and 32K is appropriately supplied to the corresponding development units of the processing units 6Y, 6M, 6C, and 6K by the toner conveyance units described below. The toner bottles 32Y, 32M, 32C, and 32K can be detached from the printer main body independently of the processing units 6Y, 6M, 6C, and 6K.

In a monochrome-mode print job, the printer according to the embodiment drives only the photosensitive body 1K among the four photosensitive bodies 1Y, 1M, 1C, and 1K. In this case, with the adjustment of the posture of the transfer unit 15, the intermediate transfer belt 8 is brought into contact with only the photosensitive body 1K among the four photosensitive bodies 1Y, 1M, 1C, and 1K. On the other hand, in a color-mode print job, all the four photosensitive bodies 1Y, 1M, 1C, and 1K are driven. In this case, with the adjustment of the posture of the transfer unit 15, the intermediate transfer belt 8 is brought into contact with all the four photosensitive bodies 1Y, 1M, 1C, and 1K.

Figure 5:
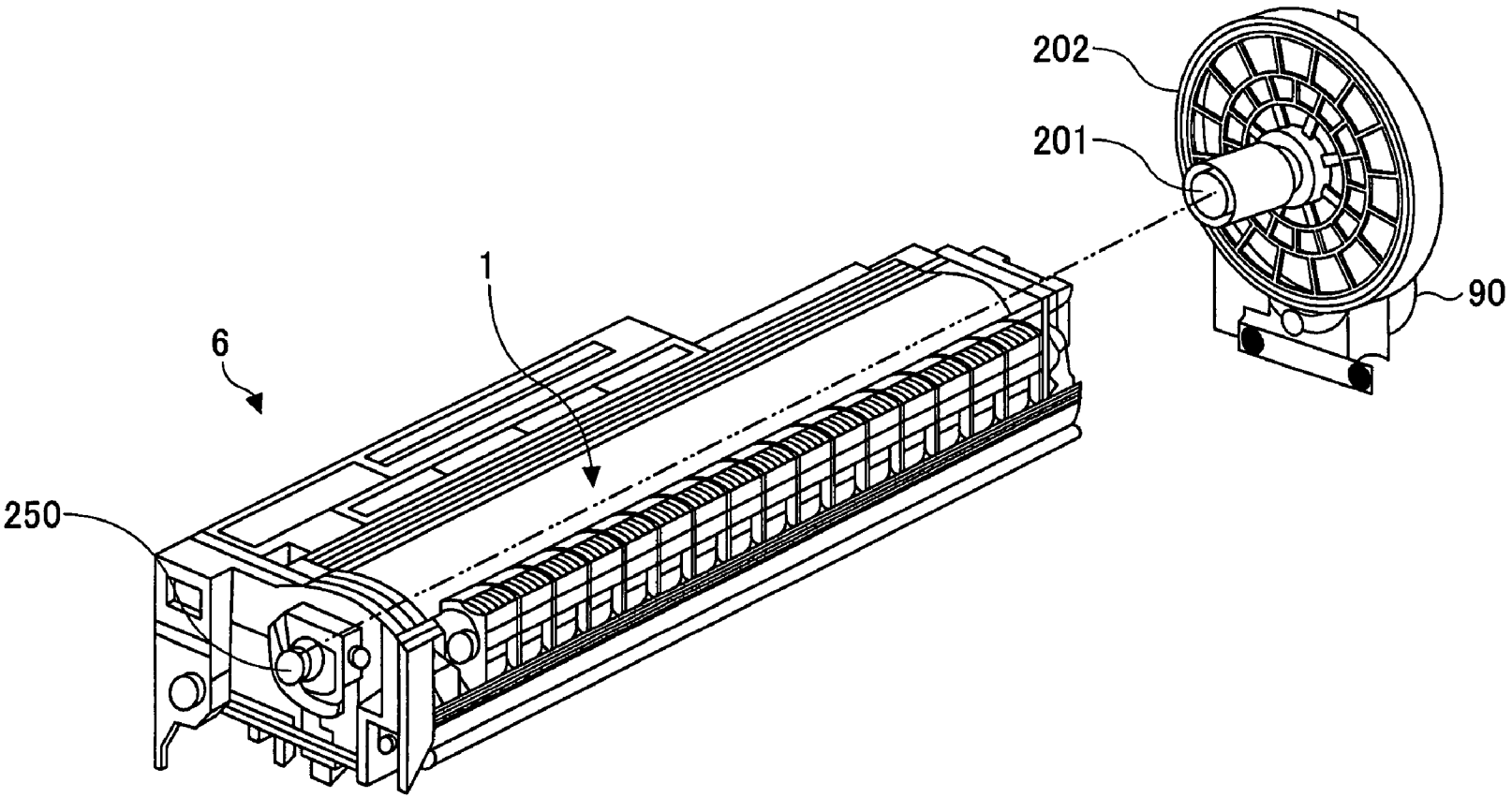
FIG. 5 is a perspective view showing the processing unit and a photosensitive-body driving system.

FIG. 5 is a perspective view showing the processing unit and a photosensitive-body driving system. Note that in the printer according to the embodiment, the configurations of the processing units and the photosensitive-body driving systems for the respective colors are almost the same. Therefore, in FIG. 5, they are not differentiated for the respective colors but shown as the common processing unit and the common photosensitive-body driving system. For this reason, characters Y, M, C, and K added after the numerals of the processing unit and the photosensitive-body driving system are omitted in FIG. 5.

The photosensitive-body driving system composed of a coupling 201 serving as a part of a connection unit, a photosensitive-body gear 202, a driving motor 90, and the like shown in FIG. 5 is fixed inside the printer main body. On the other hand, the processing unit 6 can be detached from the printer main body. The photosensitive body 1 of the processing unit 6 has rotary shaft members projecting from both-end surfaces in a rotary shaft line direction, and each of the rotary shaft members is projected outside a unit housing. A known coupling (not shown) serving as a part of the connection unit is fixed to the rotary shaft member (not shown) existing in a dead angle region in FIG. 5 between the two rotary shaft members. Furthermore, a rotary encoder 250 is fixed to the other rotary shaft member. The rotary encoder 250 detects the rotational speed of the photosensitive body 1 and outputs the detected result to a control unit described below.

On the side of the printer main body, the photosensitive-body gear 202 is supported by a support plate so as to be rotatable. The coupling 201 is formed at the rotation center of the photosensitive-body gear 202 and coupled with a coupling (not shown) fixed to the rotary shaft of the photosensitive body 1 in the shaft line direction. With this coupling, the rotational driving force of the photosensitive-body gear 202 is transmitted to the photosensitive body 1 via the two couplings. The gear of the photosensitive-body gear 202 is meshed with the motor gear of the driving motor 90, whereby the rotational driving force of the driving motor 90 is transmitted to the photosensitive-body gear 202. When the processing unit 6 is pulled out from the printer main body, the coupling (not shown) fixed to the rotary shaft member of the photosensitive body 1 and the coupling formed in the photosensitive-body gear 202 are released from each other.

Figure 6:
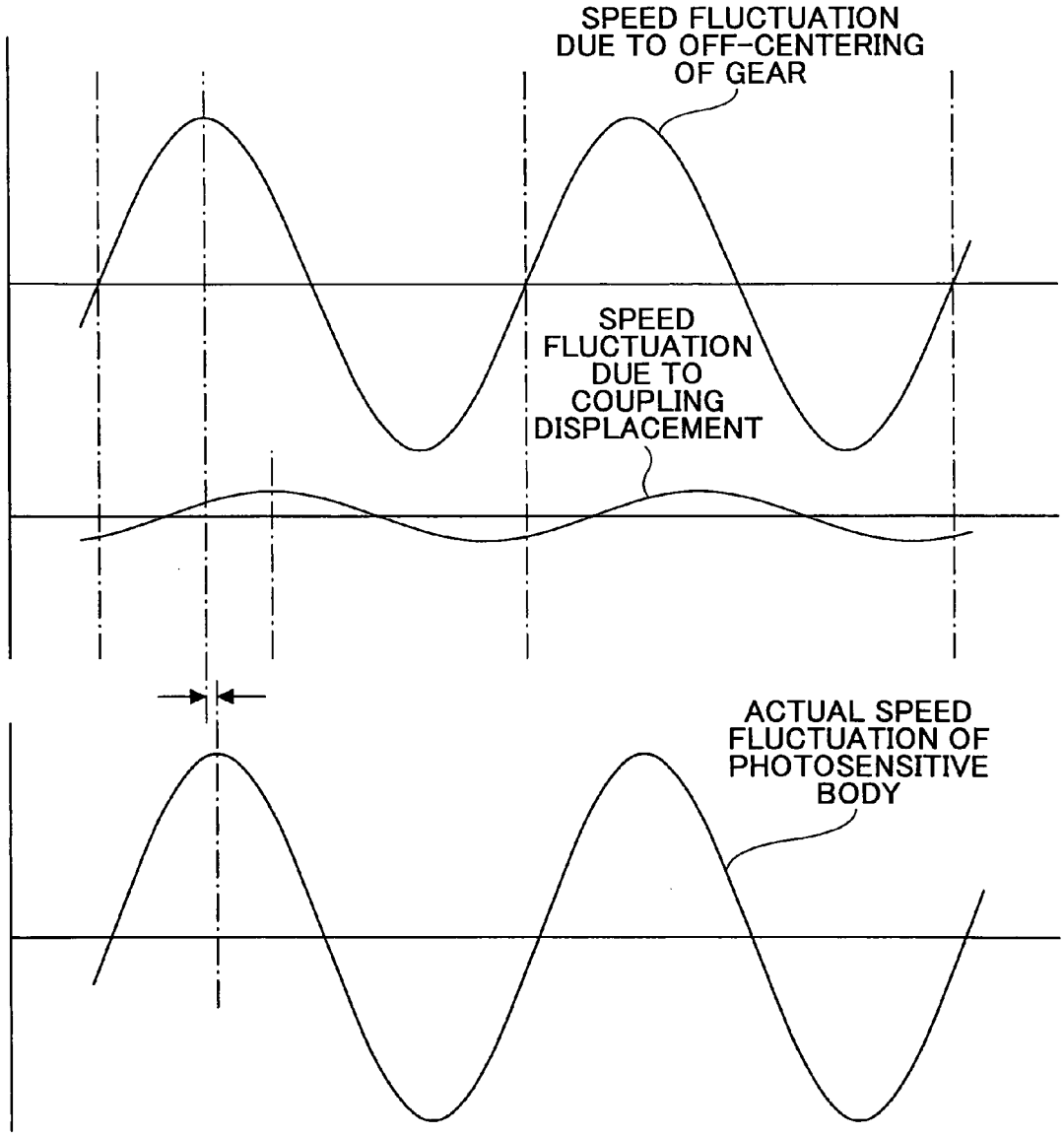
FIG. 6 is a graph showing a relationship between the speed fluctuation component of the photosensitive body due to the off-centering of the photosensitive-body gear, the speed fluctuation component of the photosensitive body due to a coupling displacement, and the actual fluctuation waveform.

When the driving motor 90 is driven at a constant speed in a configuration where such a coupling is made, a speed fluctuation where the waveforms of-two types of speed fluctuation components are superimposed one on another occurs in the photosensitive body 1. One of the two types of speed fluctuation components is a speed fluctuation due to the off-centering of the photosensitive-body gear 202 described above. Furthermore, the other one of the two types of speed fluctuation components is a speed fluctuation due to a slight displacement (hereinafter referred to as a coupling displacement) in the rotary shaft line of the two couplings coupled with each other. As shown in FIG. 6, the amplitude of the waveform of the speed fluctuation component due to the off-centering of the photosensitive-body gear 202 is significantly greater than that of the waveform of the speed fluctuation component due to the coupling displacement. This is because the turning radius of the photosensitive-body gear 202 is significantly greater than those of the couplings. The phases of the waveforms of the two types of speed fluctuation components are rarely matched to each other, but they are generally displaced from each other as shown in FIG. 6. As shown in FIG. 6, the phase of the speed fluctuation actually occurring in the photosensitive body 1, i.e., the phase of the speed fluctuation where the waveforms of the two types of speed fluctuation components are superimposed one on another is displaced from any of the phases of the waveforms of the two types of speed fluctuation components. However, it is slightly displaced from the phase of the waveform of the speed fluctuation component due to the off-centering of the photosensitive-body gear 202. In other words, the phase of the waveform of the speed fluctuation actually occurring in the photosensitive body 1 is slightly different from that of the waveform of the speed fluctuation component due to the off-centering of the photosensitive-body gear 202, but these phases are very close to each other.

In the printer according to the embodiment, the processing unit 6 and the photosensitive-body driving system shown in FIG. 5 are provided for the respective colors of Y, M, C, and K. The configurations of the processing units and the photosensitive-body driving systems for the respective colors are almost the same. However, as for the color K, the driving motor 90K drives not only the photosensitive body 1K but also the driving roller of the transfer unit. Therefore, the motor gear of the driving motor 90K is meshed with not only the photosensitive-body gear 202K but also a pulley gear (not shown) that transmits a driving force to the driving roller. In this configuration, the shared use of the driving motor 90K between the photosensitive body 1K and the driving roller can reduce manufacturing costs.

The driving of the four driving motors 90Y, 90M, 90C, and 90K is controlled by the control unit (not shown). The control unit has a CPU (Central Processing Unit) that performs arithmetic processing, a ROM (Read Only Memory) that stores a control program and various data, a RAM (Random Access Memory) that temporarily stores the various data, and the like. The control unit performs speed fluctuation waveform recognition processing at a predetermined timing such as a timing immediately after the power of the printer is turned on or a timing immediately after an operation for detaching the processing unit 6 is detected. In the speed fluctuation waveform recognition processing, the control unit first drives the driving motors 90Y, 90M, 90C, and 90K that drive the photosensitive bodies 1Y, 1M, 1C, and 1K, respectively, at a predetermined speed. Then, the control unit detects the speed fluctuation waveforms of the photosensitive bodies 1Y, 1M, 1C, and 1K based on outputs from the rotary encoders 250Y, 250M, 250C, and 250K fixed to the photosensitive bodies 1Y, 1M, 1C, and 1K, respectively.

Figure 1:
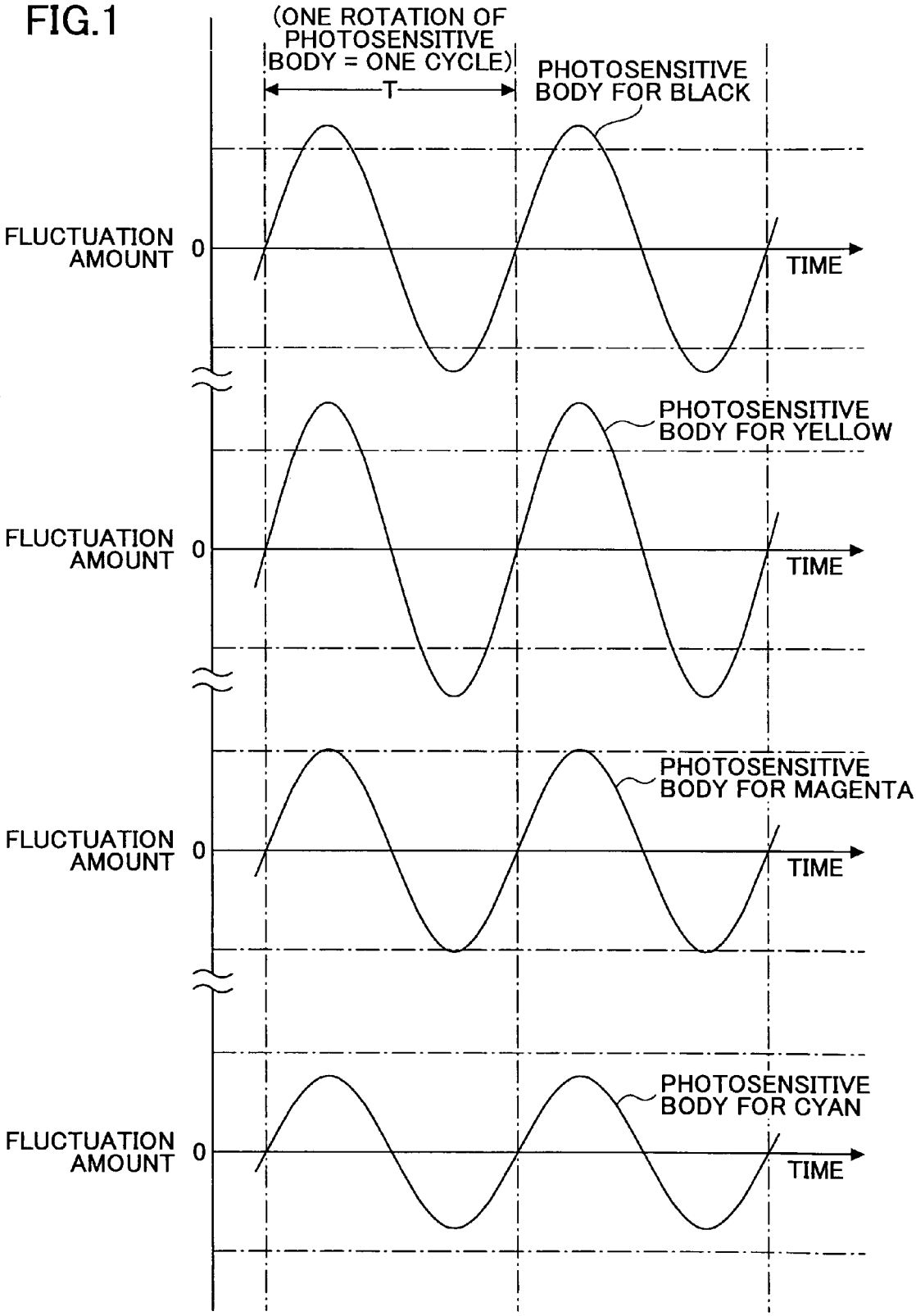
FIG. 1 is a graph exemplifying actual fluctuation waveforms of photosensitive bodies for respective colors.
Figure 2:
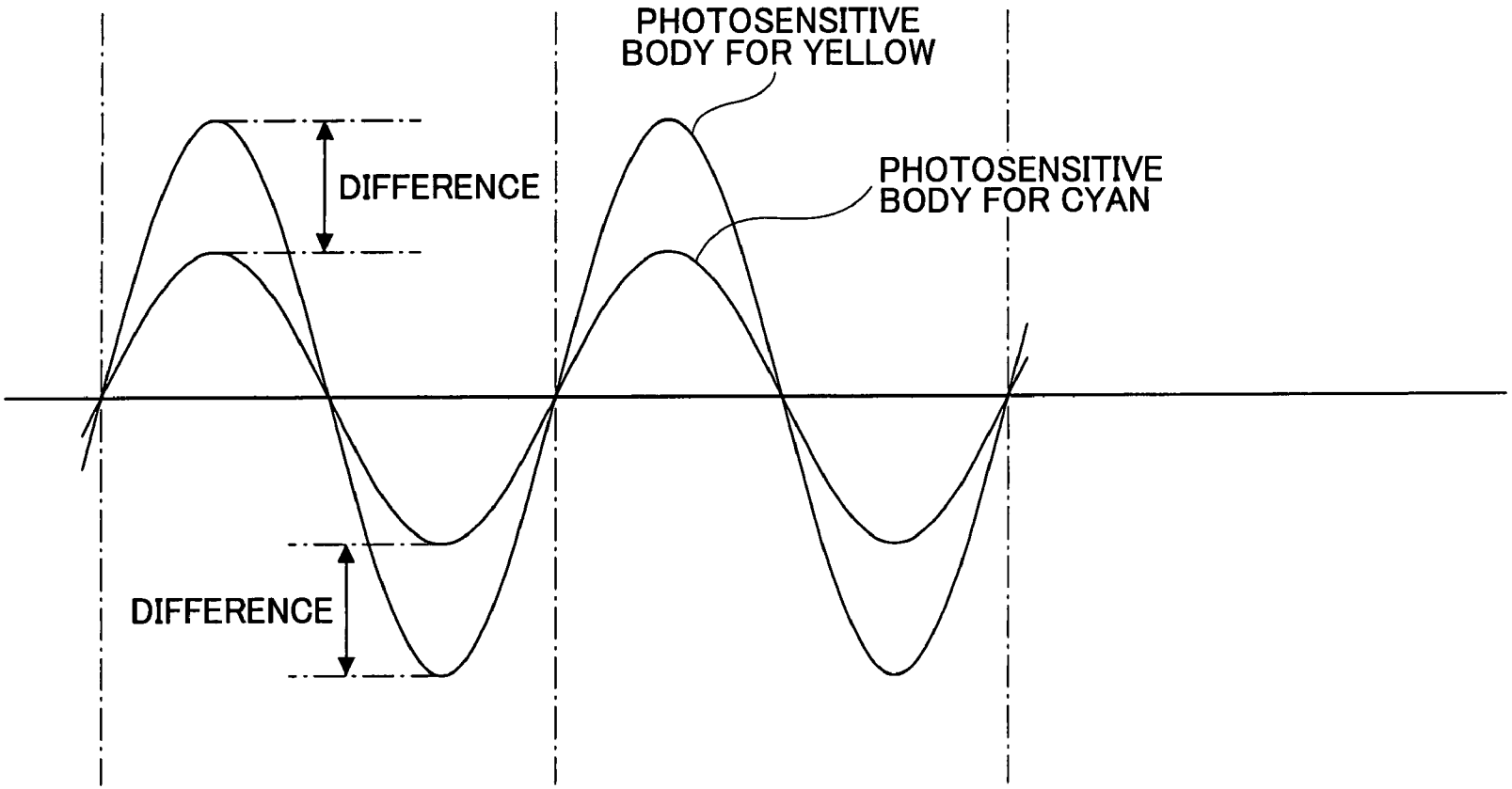
FIG. 2 is a graph for explaining matching of the phases of the actual fluctuation waveforms of two photosensitive bodies and a difference between amplitudes of the actual fluctuation waveforms.
Figure 7:
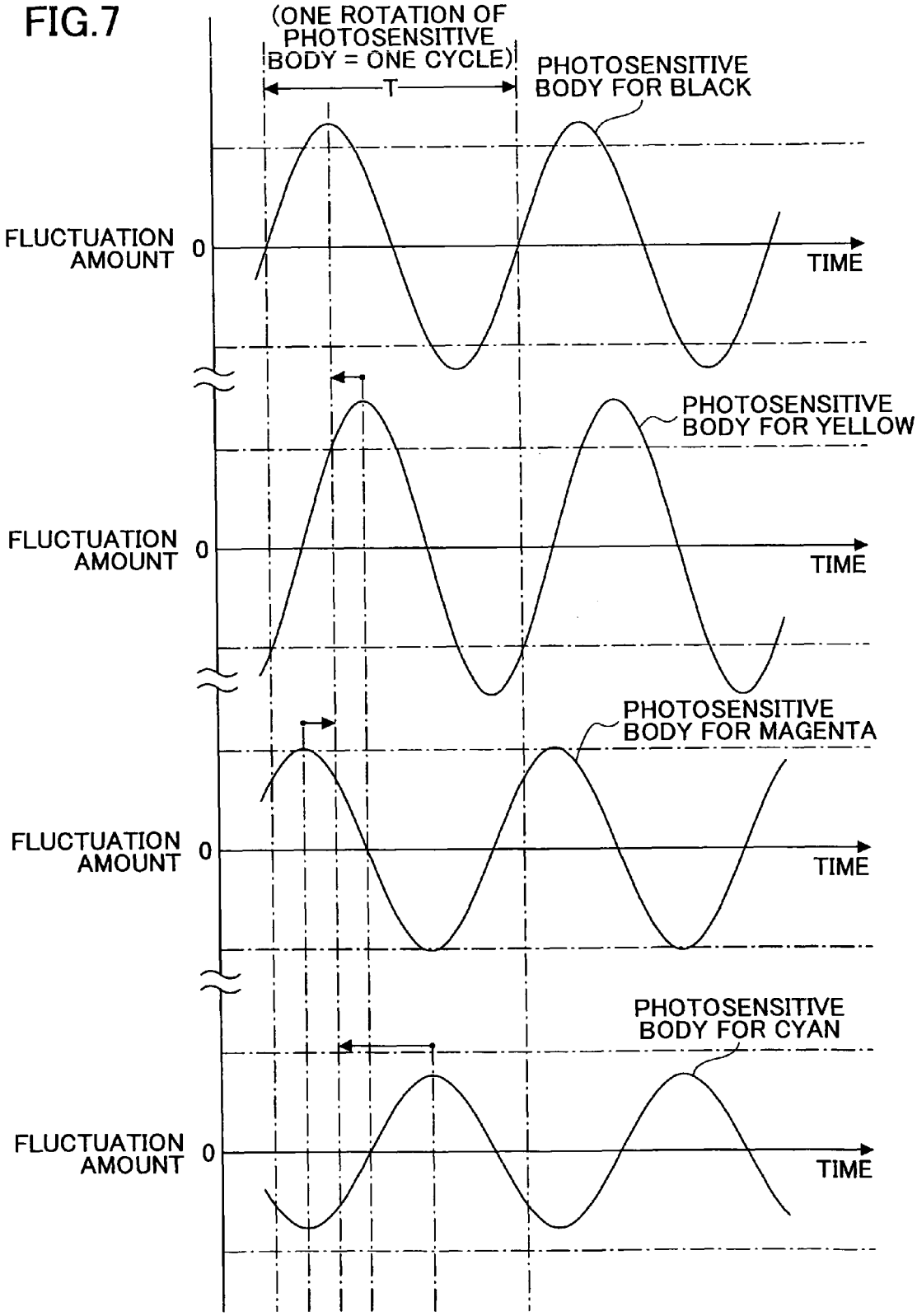
FIG. 7 is a graph showing an example of the four actual fluctuation waveforms detected by speed fluctuation waveform processing.

FIG. 7 is a graph showing examples of the speed fluctuation waveforms detected by the speed fluctuation waveform recognition processing. Specifically, a fluctuation amount in a vertical axis direction in FIG. 7 represents a speed fluctuation amount (mm/s) or a displacement amount (μm). Taking the displacement amount (μm) as an example, a scale marked at a region on the positive side in the vertical axis indicates about +10 μm. Furthermore, a scale marked at a region on the negative side in the vertical axis indicates about −10 μm (the same applies to FIG. 1 and FIG. 8 described below). As shown in FIG. 7, the phases and amplitudes of the speed fluctuation waveforms of the photosensitive bodies 1Y, 1M, 1C, and 1K detected immediately after the driving motors 90Y, 90M, 90C, and 90K are driven at a predetermined speed are different from each other. After detecting the speed fluctuation waveforms of the photosensitive bodies 1Y, 1M, 1C, and 1K shown in FIG. 7, the control unit recognizes a reference timing per rotation (one cycle) for each of the photosensitive bodies 1Y, 1M, 1C, and 1K driven at a constant speed based on the outputs from the rotary encoders 250Y, 250M, 250C, and 250K. The reference timing indicates that the photosensitive-body gear has a predetermined rotational angle. The predetermined rotational angle may be set to any angle. However, in the printer according to the embodiment, the reference timing is set to a timing at which the minimum-diameter part of the photosensitive body gear is meshed with the motor gear, i.e., a timing at which a peak on the positive side of the speed fluctuation waveform is obtained. The reference timing is recognized for each of the photosensitive bodies 1Y, 1M, 1Q, and 1K driven at a constant speed based on the outputs from the rotary encoders 250Y, 250M, 250C, and 250K every time the photosensitive bodies 1Y, 1M, 1C, and 1K rotate 360°. Then, the driving amounts of the driving motors 90Y, 90M, and 90C are temporarily changed, so that the reference timings of the photosensitive bodies 1Y, 1M, and 1C are synchronized with that of the photosensitive body 1K. Thus, as shown in FIG. 8, the phases of the speed fluctuation waveforms of the photosensitive bodies 1Y, 1M, 1C, and 1K are matched to each other.

After the phases of the speed fluctuation waveforms are matched to each other, a driving speed pattern is determined by which the amplitudes of the waveforms (second waveforms) of the photosensitive bodies 1Y, 1M, and 1C can be matched to that of the speed fluctuation waveform (first waveform) of the photosensitive body 1K. In an example shown in FIG. 8, the amplitude of the second waveform (as indicated by dotted lines in FIG. 8) of the photosensitive body 1Y obtained when the driving motor for the color Y is driven at a constant speed is greater than that of the first waveform as the speed fluctuation waveform of the photosensitive body 1K obtained when the driving motor for the color K is driven at a constant speed. Accordingly, the control unit makes the speed fluctuation amount of the photosensitive body 1Y slightly smaller than that obtained when the photosensitive body 1Y is driven at the constant speed, thereby determining the driving speed pattern by which the speed fluctuation waveform of the photosensitive body 1Y is almost matched to the first waveform of the photosensitive body 1K. Then, the driving speed of the driving motor for the color Y is finely adjusted in accordance with the driving speed pattern, so that the speed fluctuation waveform of the photosensitive body 1Y is almost matched to the first waveform of the photosensitive body 1K as indicated by a solid line in FIG. 8 (not only the phases but also the amplitudes of the photosensitive bodies are matched to each other). Thus, there is established a state in which the displacement in the superimposition of the dots of the K-toner image and those of the Y-toner image can be almost eliminated.

Figure 8:
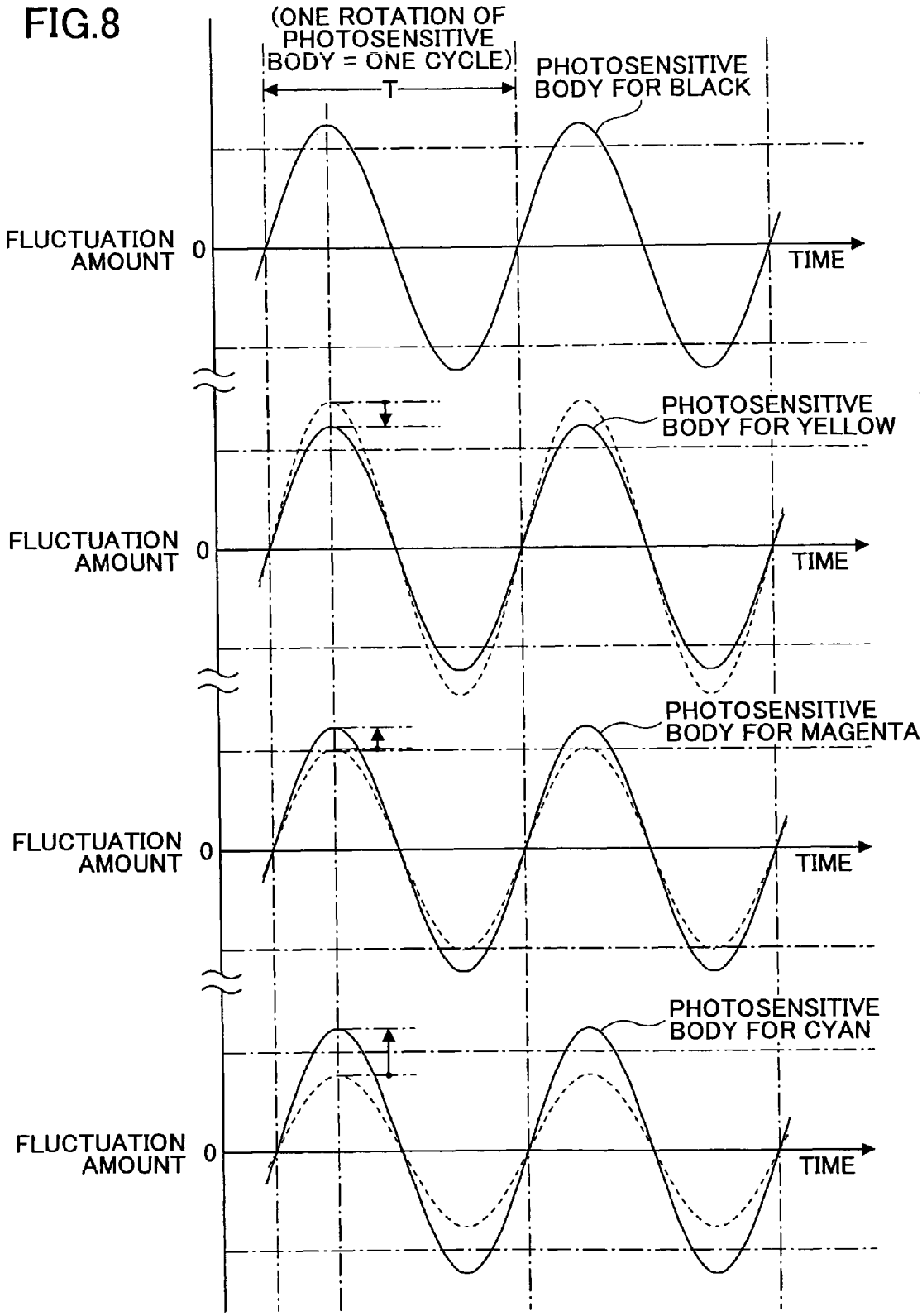
FIG. 8 is a graph showing the four actual fluctuation waveforms after the phases of the actual fluctuation waveforms are matched to each other.

In an example shown in FIG. 8, the amplitude of the second waveform (as indicated by dotted lines in FIG. 8) of the photosensitive body 1M obtained when the driving motor for the color M is driven at a predetermined speed is smaller than that of the first waveform of the photosensitive body 1K. Accordingly, the control unit makes the speed fluctuation amount of the photosensitive body 1M slightly greater than that obtained when the photosensitive body 1M is driven at the constant speed, thereby determining the driving speed pattern by which the speed fluctuation waveform of the photosensitive body 1M is almost matched to the first waveform of the photosensitive body 1K. Then, the driving speed of the driving motor for the color M is finely adjusted in accordance with the driving speed pattern, so that the speed fluctuation waveform of the photosensitive body 1M is almost matched to the first waveform of the photosensitive body 1K as indicated by a solid line in FIG. 8. Thus, there is established a state in which the displacement in the superimposition of the dots of the K-toner image and those of the M-toner image can be almost eliminated. It should be noted here that if the amplitude of the second waveform obtained when the photosensitive body is driven at the constant speed is smaller than that of the first waveform of the photosensitive body 1K, the driving speed of the driving motor is adjusted to intentionally increase the speed fluctuation amount. As described above, the speed fluctuation amount is intentionally increased so that the speed fluctuation waveform is almost matched to the first waveform of the photosensitive body 1K. Thus, the displacement in the superimposition of the dots can be almost eliminated. In this respect, the present invention is completely different in technology from the invention described in Patent Document 1 that significantly reduces the speed fluctuations of any of the photosensitive bodies for the respective colors by finely adjusting the driving speeds of the driving motors so as to reduce the displacements in the superimposition of the dots of the respective colors.

In an example shown in FIG. 8, the amplitude of the second waveform (as indicated by dotted lines in FIG. 8) of the photosensitive body 1C obtained when the driving motor for the color C is driven at a constant speed is also smaller than that of the first waveform of the photosensitive body 1K. Accordingly, the control unit makes the speed fluctuation amount of the photosensitive body 1C slightly greater than that obtained when the photosensitive body 1C is driven at the constant speed, thereby determining the driving speed pattern by which the speed fluctuation waveform of the photosensitive body 1C is almost matched to the first waveform of the photosensitive body 1K. Then, the driving speed of the driving motor for the color C is finely adjusted in accordance with the driving speed pattern, so that the speed fluctuation waveform of the photosensitive body 1C is almost matched to the first waveform of the photosensitive body 1K as indicated by a solid line in FIG. 8. Thus, there is established a state in which the displacement in the superimposition of the dots of the K-toner image and those of the C-toner image can be almost eliminated.

After the establishment of the state in which the displacements in the superimposition of the dots of the colors Y, M, C, and K are almost eliminated as described above, optical writing on the photosensitive bodies 1Y, 1M, 1C, and 1K is started. Thus, in the printer according to the embodiment, the displacements in the superimposition of the dots of the respective colors can be kept at a tolerance level.

Note that in the printer according to the embodiment, the combination of the control unit and the rotary encoders 250Y, 250M, 250C, and 250K serves as a waveform recognition unit that recognizes the first waveform as the speed fluctuation waveform per rotation of the photosensitive body 1K driven by the driving force of the driving motor for the color K driving at the constant speed and the second waveforms as the speed fluctuation waveforms per rotation of the photosensitive bodies 1Y, 1M, and 1C driven by the driving forces of the driving motors for the colors Y, M, and C driving at the constant speed. In addition, the combination serves as a rotation detection unit that detects whether each of the photosensitive bodies 1Y, 1M, 1C, and 1K has a predetermined rotational angle.

EXAMPLES

Next, a description is made of a printer according to examples obtained by adding a more characteristic configuration to the printer according to the embodiment. Note that the configuration of the printer according to the examples is the same as that of the printer according to the embodiment unless otherwise specified.

Figure 9:
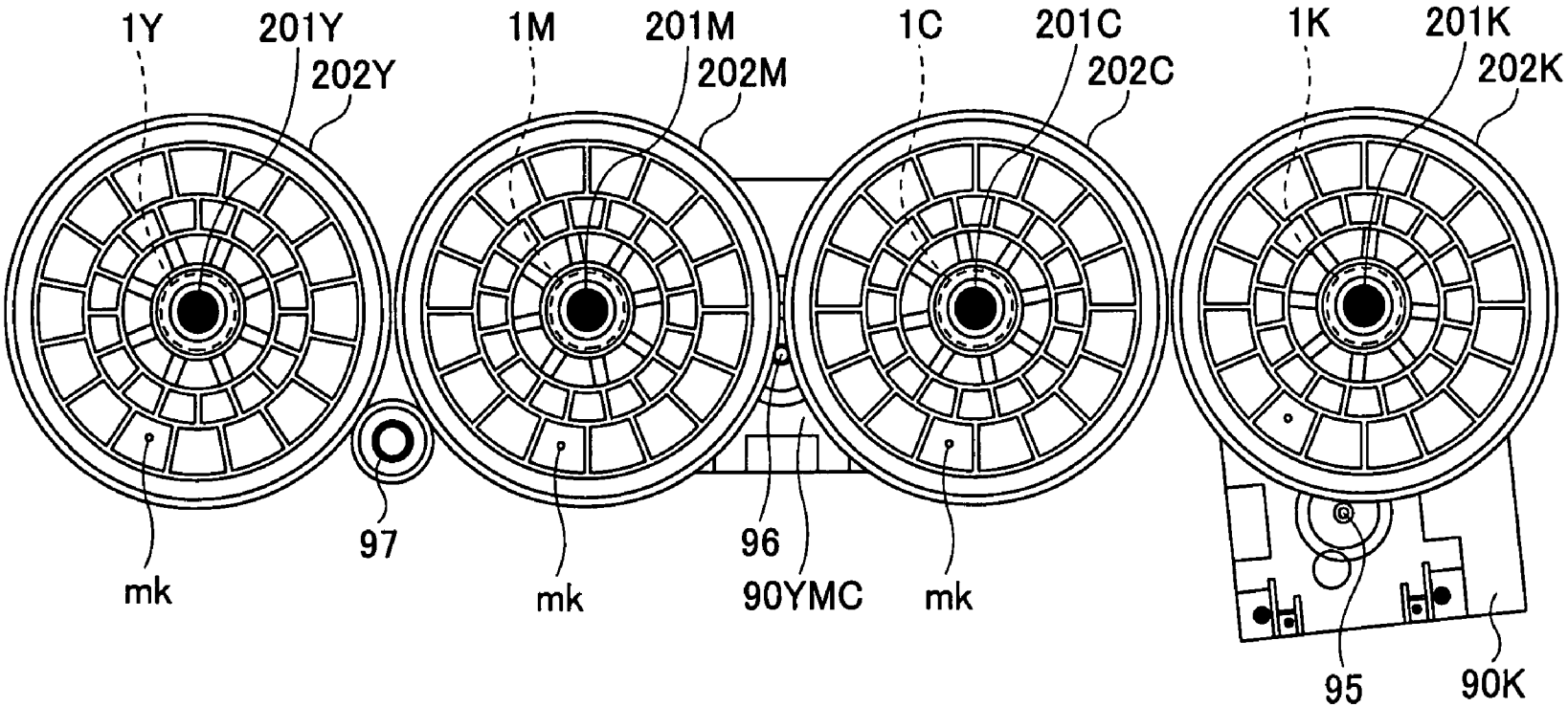
FIG. 9 is an enlarged configuration diagram showing the circumferential configuration of the four photosensitive bodies in the printer.
Figure 10:
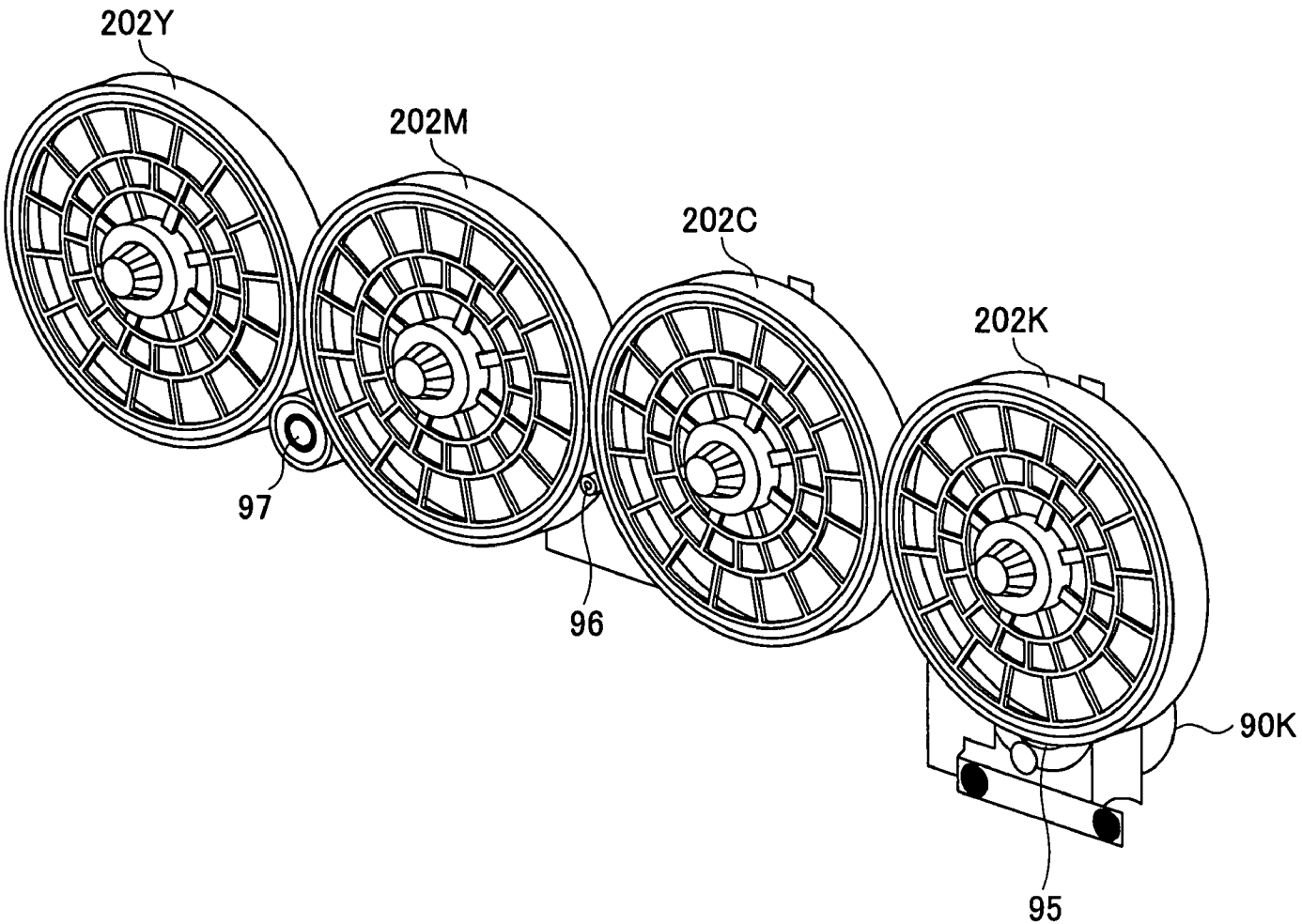
FIG. 10 is a perspective view showing the circumferential configuration of the four photosensitive bodies in the printer.

FIG. 9 is an enlarged configuration diagram showing the circumferential configuration of the four photosensitive bodies 1Y, 1M, 1C, and 1K in the printer according to the embodiment. Furthermore, FIG. 10 is a perspective view showing the same circumferential configuration. In FIGS. 9 and 10, the photosensitive-body gear 202K for the color K is meshed with a motor gear 95 for the color K fixed to the motor shaft of the driving motor 90K. When the photosensitive-body gear 202K is meshed with the motor gear 95, the rotational driving force of the driving motor 90K is transmitted to the photosensitive body 1K, so that the photosensitive body 1K is rotated and driven. In addition, the pulley gear (not shown) is also meshed with the motor gear 95. When the pulley gear is rotated, the driving force of the driving motor 90K is transmitted to the driving roller (not shown).

On the other hand, a motor gear 96 for the colors Y, M, and C is provided between a photosensitive-body gear 202M for the color M and a photosensitive-body gear 202C for the color C so as to be meshed with them. The color motor gear 96 is fixed to the motor shaft of a driving motor 90YMC for the colors Y, M, and C and transmits the driving force of the driving motor 90YMC to the photosensitive-body gears 202M and 202C. Thus, the photosensitive bodies 1M and 1C are rotated and driven. Furthermore, an idler gear 97 is provided between a photosensitive-body gear 202Y for the color Y and the photosensitive-body gear 202M so as to be meshed with them. Thus, the driving force of the driving motor 90YMC is transmitted to the photosensitive body 1Y successively via the color motor gear 96, the photosensitive-body gear 202M, the idler gear 97, and the photosensitive-body gear 202Y.

With this configuration, the three photosensitive bodies 1Y, 1M, and 1C other than the photosensitive body 1K are rotated and driven by the driving motor 90YMC. The photosensitive-body gears 202Y, 202M, and 202C corresponding to the three photosensitive bodies 1Y, 1M,and 1C are meshed with each other so as to rotate in a state in which their maximum off-centering parts (maximum-diameter parts) are positioned at the same rotational angle. Specifically, the photosensitive-body gears 202Y, 202M, and 202C have marks mk inscribed at the maximum off-centering parts. The photosensitive-body gears 202Y, 202M, and 202C are meshed with each other in a state in which the marks mk are positioned at the same rotational angle. In a state shown in FIG. 9, the marks mk of the photosensitive-body gears 202Y, 202M, and 202C are stopped at the position of 7 o'clock. That is, the rotational phases by the off-centering of the photosensitive-body gears 202Y, 202M, and 202C are synchronized with each other.

In the printer according to the embodiment, the arrangement pitches of the photosensitive bodies are set to be equal. Therefore, the synchronization of the rotational phases of the photosensitive-body gears can realize the following matter. That is, the expansion and contraction patterns of the dots of the colors Y, M, and C due to the off-centering of the photosensitive-body gears 202Y, 202M, and 202C can be synchronized with each other at the primary transfer nips.

As described above, in the photosensitive-body driving system of the printer, the speed fluctuation component of the photosensitive body due to the off-centering of the photosensitive-body gear (hereinafter referred to as a gear speed fluctuation component) and that of the photosensitive body due to the coupling displacement (hereinafter referred to as a coupling speed fluctuation component) occur. Furthermore, the speed fluctuation waveform actually occurring in the photosensitive body is a waveform where the waveforms of these two speed fluctuation components are superimposed one on another (hereinafter referred to as an actual fluctuation waveform), and the phase of the actual fluctuation waveform is slightly displaced from that of the waveform of the gear speed fluctuation component. However, as described above, since the gear speed fluctuation component is significantly greater than the coupling speed fluctuation component, the phase of the actual fluctuation waveform is very close to that of the gear speed fluctuation component. Thus, the photosensitive-body gears 202Y, 202M, and 202C are meshed with each other so that the rotational phases due to the off-centerings of the photosensitive-body gears 202Y, 202M, and 202C are synchronized with each other. As a result, the actual fluctuation waveforms of the photosensitive bodies 1Y, 1M, and 1C can be almost synchronized with each other.

Any of the photosensitive-body gears 202Y, 202M, and 202C is manufactured by molding a resin through a die, and an off-centering position and a off-centering amount are determined by the die. Therefore, a groove for molding the mark mk is inscribed at the maximum off-centering part of the die in advance. Thus, the mark mk can be formed at the same time when the resin is molded. In this manner, any of the marks mk of the photosensitive-body gears 202Y, 202M, and 202C shown in FIG. 9 is formed at the same time when the resin is molded. When a gear in which the mark mk is not formed at the same time when a resin is molded is used as the photosensitive-body gear, the maximum off-centering part of the gear may be specified by a measurement unit so that the mark mk is added to the gear. An example of the measurement unit includes a sensor that is provided next to the gear and measures a distance fluctuation between the sensor and the tooth-tip of the gear while the gear is rotated and driven. Another example may include the following configuration. That is, a gear is attached to a rotary shaft to which an encoder is fixed, and a motor gear is meshed with the gear so as to be rotated and driven. Thus, the maximum off-centering part is specified based on an output from the encoder.

The photosensitive body 1K is rotated and driven by the driving motor 90K serving as a driving source that is used for the photosensitive bodies 1Y, 1M, and 1C. Since demand for monochrome printing is higher than that for color printing, only the photosensitive body 1K has the independent driving source. For monochrome printing higher in demand, only the photosensitive body 1K is driven to reduce the waste of the photosensitive bodies 1Y, 1M, and 1C and promote energy savings.

Since only the photosensitive body 1K is rotated and driven for monochrome printing, the phase at the maximum off-centering part of the photosensitive-body gear 202K is different from that at the maximum off-centering parts of the photosensitive-body gears 202Y, 202M, and 202C for any cost. Therefore, when a printing operation is started, the printer is configured to perform phase-difference matching control in which a rotational phase difference between the photosensitive-body gear 202K and the photosensitive-body gears 202Y, 202M, and 202C is made zero.

Figure 11:
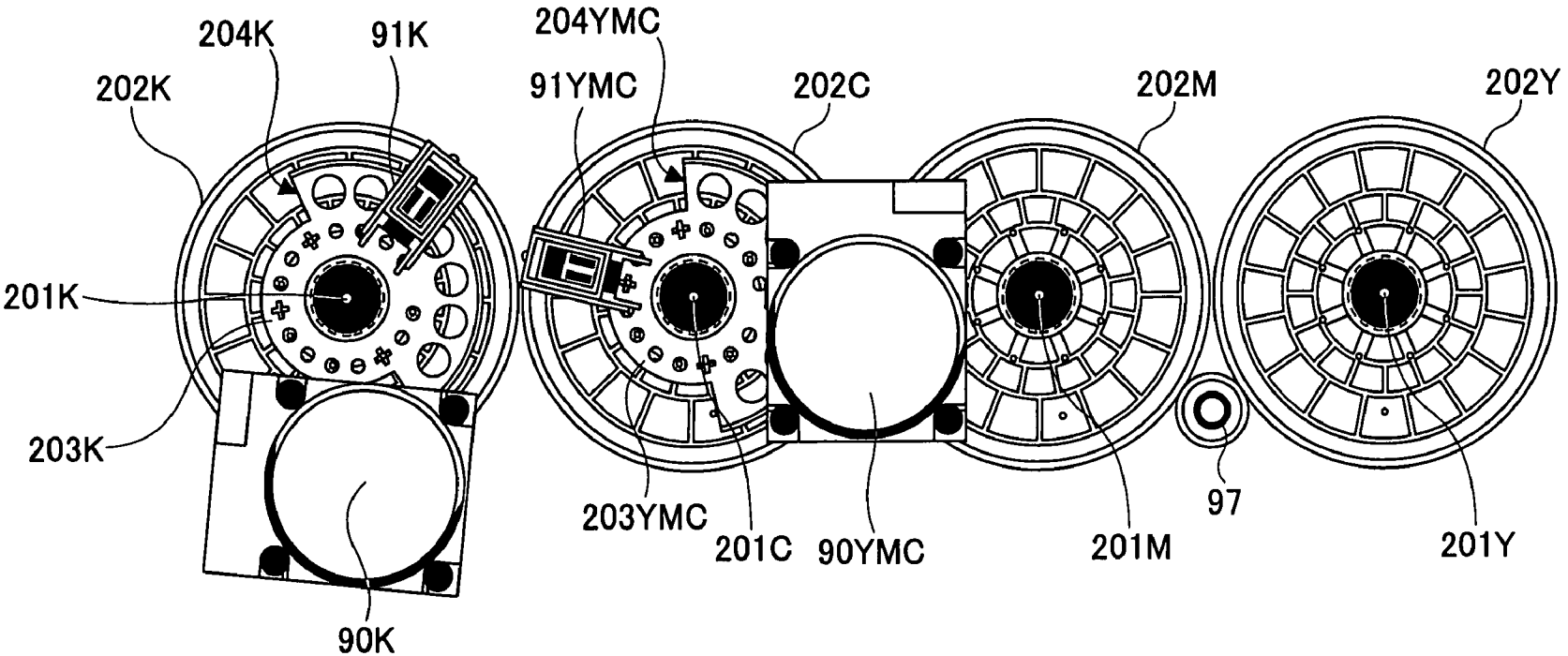
FIG. 11 is an enlarged configuration diagram showing the circumferential configuration of the four photosensitive bodies as seen from the opposite side of the photosensitive bodies shown in FIG. 9.

FIG. 11 is an enlarged configuration diagram showing the circumferential configuration of the four photosensitive bodies as seen from the opposite side of the four photosensitive bodies shown in FIG. 9. In FIG. 11, a rotary disc 203K for the color K is fixed to an end part on the side opposite to the photosensitive-body gear 202K in the coupling 201K of the photosensitive body 1K. The rotary disc 203K is integrally formed with a large-diameter part 204K that partially increases the diameter of the rotary disc 203K. When the photosensitive-body gear 202K reaches a predetermined rotational position, the large-diameter part 204 is detected by a gear sensor 91K for the color K composed of a transmission-type photosensor.

On the other hand, a rotary disc 203YMC for the colors Y, M, and C is fixed to an end part on the side opposite to the photosensitive-body gear 202C in the coupling 201C of the photosensitive body 1C. The rotary disc 203YMC is also integrally formed with a large-diameter part 204YMC that partially increases the diameter of the rotary disc 203YMC. When the photosensitive-body gears 202Y, 202M, and 202C reach a predetermined rotational position, the large-diameter part 204YMC is detected by a gear sensor 91YMC for the colors Y, M, and C composed of the transmission-type photosensor.

Note that in the printer, the rotary disc 203K and the rotary disc 203YMC are attached so that the large-diameter part 204K and the large-diameter part 204YMC are positioned at the same rotational angle as the maximum-diameter part of the photosensitive-body gear.

Figure 12:
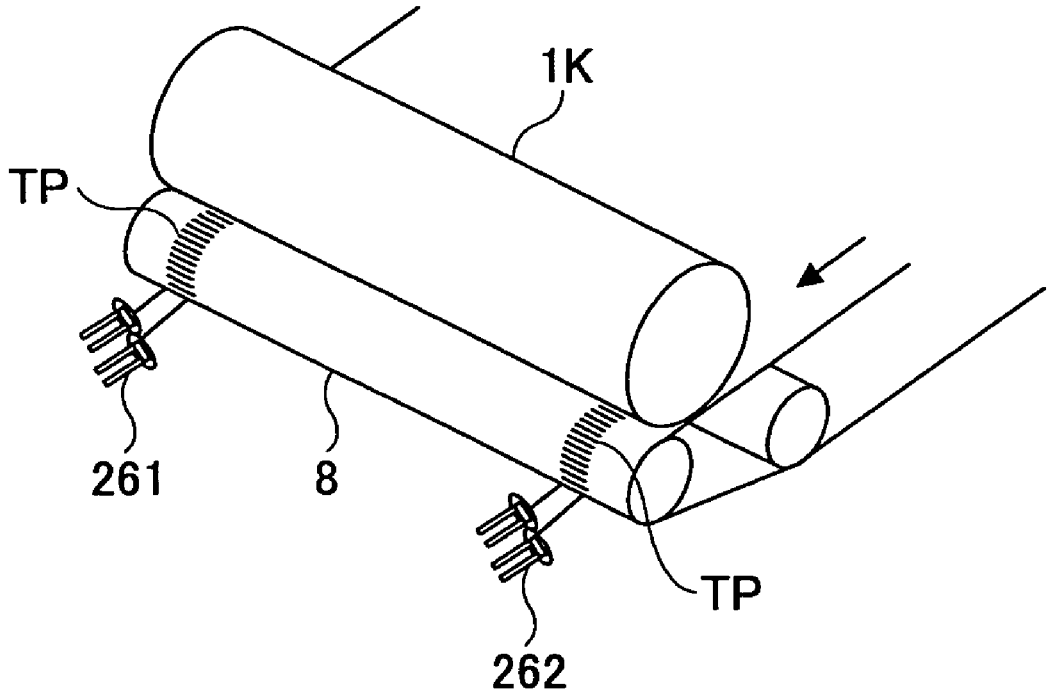
FIG. 12 is a perspective view showing a part of an intermediate transfer belt and the circumferential configuration of the part of the intermediate transfer belt in the printer according to examples.

FIG. 12 is a perspective view showing a part of the intermediate transfer belt 8 and the circumferential configuration of the part of the intermediate transfer belt 8 in the printer according to the examples. In FIG. 12, a first toner-image detection sensor 261 faces one end part in the width direction of the intermediate transfer belt 8 with a predetermined gap. Furthermore, a second toner-image detection sensor 262 faces the other end part with a predetermined gap. These toner-image detection sensors are each composed of a reflection-type photosensor and the like and detect a toner image on the intermediate transfer belt 8 to output a detection signal.

Figure 13:
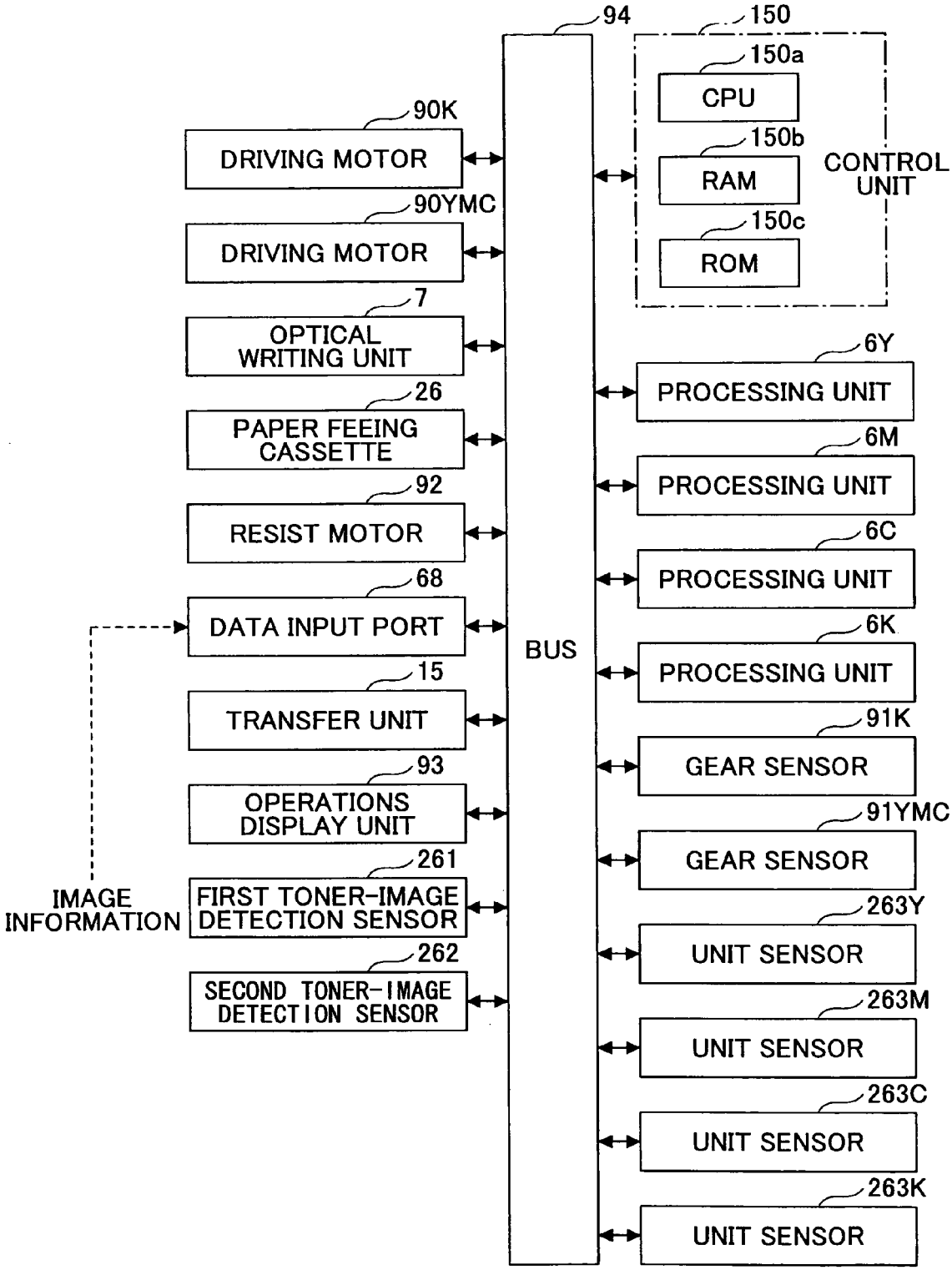
FIG. 13 is a block diagram showing a part of an electric circuit of the printer.

FIG. 13 is a block diagram showing a part of the electric circuit of the printer. In FIG. 13, a bus 94 is connected to the processing units 6Y, 6M, 6C, and 6K, the optical writing unit 7, the paper feeding cassette 26, a resist motor 92, a data input port 68, the transfer unit 15, an operations display unit 93, the control unit 150, and the like. In addition, the bus 94 is connected to the processing units 6Y, 6M, 6C, and 6K, the gear sensor 91K, the gear sensor 91YMC, and the like. Moreover, the bus 94 is connected to the first toner-image detection sensor 261, the second toner-image detection sensor 262, a unit sensor 263Y for the color Y, a unit sensor 263M for the color M, a unit sensor 263C for the color C, a unit sensor 263K for the color K, and the like.

The resist motor 92 is a driving source for the pair of the resist rollers 28. The data input port 68 receives image information transmitted from external personal computers (not shown), or the like. The control unit 150 controls the driving of the entire printer and has the CPU 150*a*, the RAM 150*a* serving as an information storage unit, a ROM 150*b*, and the like. The operations display unit 93 is composed of a touch panel or a liquid crystal panel and plural touch keys. Through the operations display unit 93, various information items are displayed in accordance with the control of the control unit 150, and input information from an operator is transmitted to the control unit 150. The four unit sensors 263Y, 263M, 263C, and 263K detect the processing units 6Y, 6M, 6C, and 6K, respectively, provided in the printer main body to output detection signals. Based on the fact that the detection signal from the unit sensor which has not been detected is detected again, the control unit 150 detects the detachment operation of the processing unit corresponding to the unit sensor. In other words, the printer has a detachment detection unit that separately detects the detachment operations of the photosensitive bodies 1Y, 1M, 1C, and 1K from the printer main body with the unit sensors 263Y, 263M, 263C, and 263K and the control unit 150.

Figure 14:
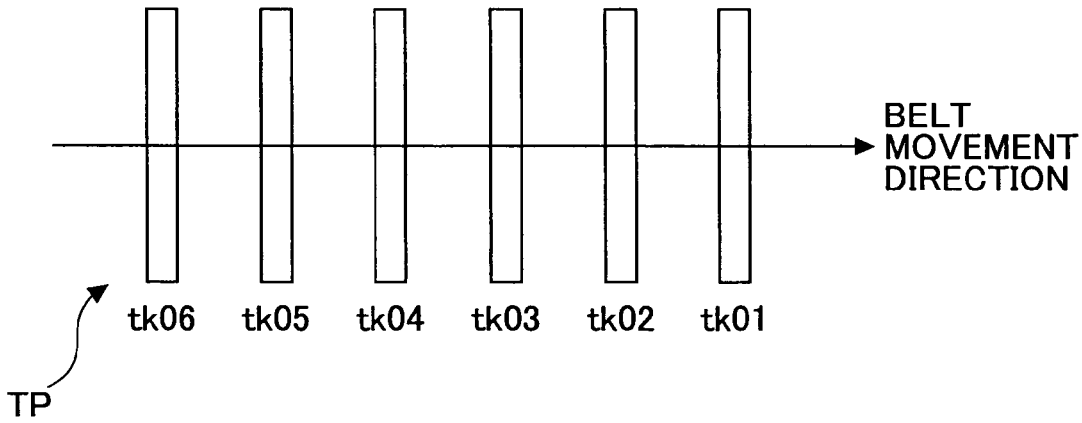
FIG. 14 is an enlarged schematic diagram showing a pattern image formed on the intermediate transfer belt.

When the control unit 150 detects the detachment operation of any of the processing units, it performs waveform acquisition processing for acquiring the actual fluctuation waveform of the photosensitive body of at least the detached processing unit prior to the starting of a print job in accordance with instructions from the user. In the waveform acquisition processing, a pattern image for detecting the speed fluctuation waveform is first formed on the intermediate transfer belt 8. As shown in FIG. 14, the pattern image is composed of patch-like toner images tk01, tk02, tk03, etc., arranged in a belt movement direction. For example, when the control unit 150 detects the detachment operation of the processing unit 6K, it forms a pattern image TP for the color K composed of plural patch-like black toner images arranged in the belt movement direction by using the processing unit 6K. If no speed fluctuations occur in the photosensitive body 1K, the black toner images are arranged at predetermined intervals. However, speed fluctuations actually occur in the photosensitive body 1K at any cost due to the off-centering of the gear and the coupling displacement. For this reason, an error occurs in the intervals between the plural black toner images of the pattern image TP formed on the intermediate transfer belt 8. This error reflects the speed fluctuation of the photosensitive body 1K. The control unit 150 detects the actual fluctuation waveform of the photosensitive body 1K based on a time interval obtained when the respective black toner images of the pattern image TP on the intermediate transfer belt 8 are detected by the first toner-image detection sensor 261 shown in FIG. 12. Then, the control unit 150 updates the data of the actual fluctuation waveform for the color K that have been stored in the RAM to the newly detected one.

Note that when the control unit 150 detects the detachment operations of the two processing units at the same time, it forms the pattern image TP corresponding to one processing unit at one end part in the width direction of the intermediate transfer belt 8 so as to be detected by the first toner-image detection sensor 261 and forms the pattern image TP corresponding to the other processing unit at the other end part in the width direction of the transfer belt 8 so as to be detected by the second toner-image detection sensor 262.

Furthermore, when the control unit 150 detects the detachment operations of the three or four processing units, it first forms the pattern images TP for two of the processing units so as to be detected by the first and second toner-image detection sensors 261 and 262. Then, the control unit 150 forms the pattern images TP for the remaining two or one of the processing units so as to be detected by the first and second toner-image detection sensors 261 and 261 in a similar fashion.

Furthermore, toner-image detection sensors may be provided facing the photosensitive bodies 1Y, 1M, 1C, and 1K so that the pattern image TP is detected on the photosensitive bodies for 1Y, 1M, 1C, and 1K not on the intermediate transfer belt 8.

Next, a description is made of a printer according to specific examples obtained by adding a more characteristic configuration to the printer according to the examples. Note that the configuration of the printer according to the specific examples is the same as that of the printer according to the examples unless otherwise specified.

First Specific Example

When the color K of the photosensitive body 1K that uses the driving motor also as the driving source for the driving roller is recognized as a reference color, recognition of a displacement of dots of the color M from the color K among the colors Y, M, and C is the most suitable. Thus, in the printer according to a first specific example, the actual fluctuation waveform of the photosensitive body 1M among the three photosensitive bodies 1Y, 1M, and 1C that share the driving motor 90YMC is matched to that of the photosensitive body 1K.

Figure 15:
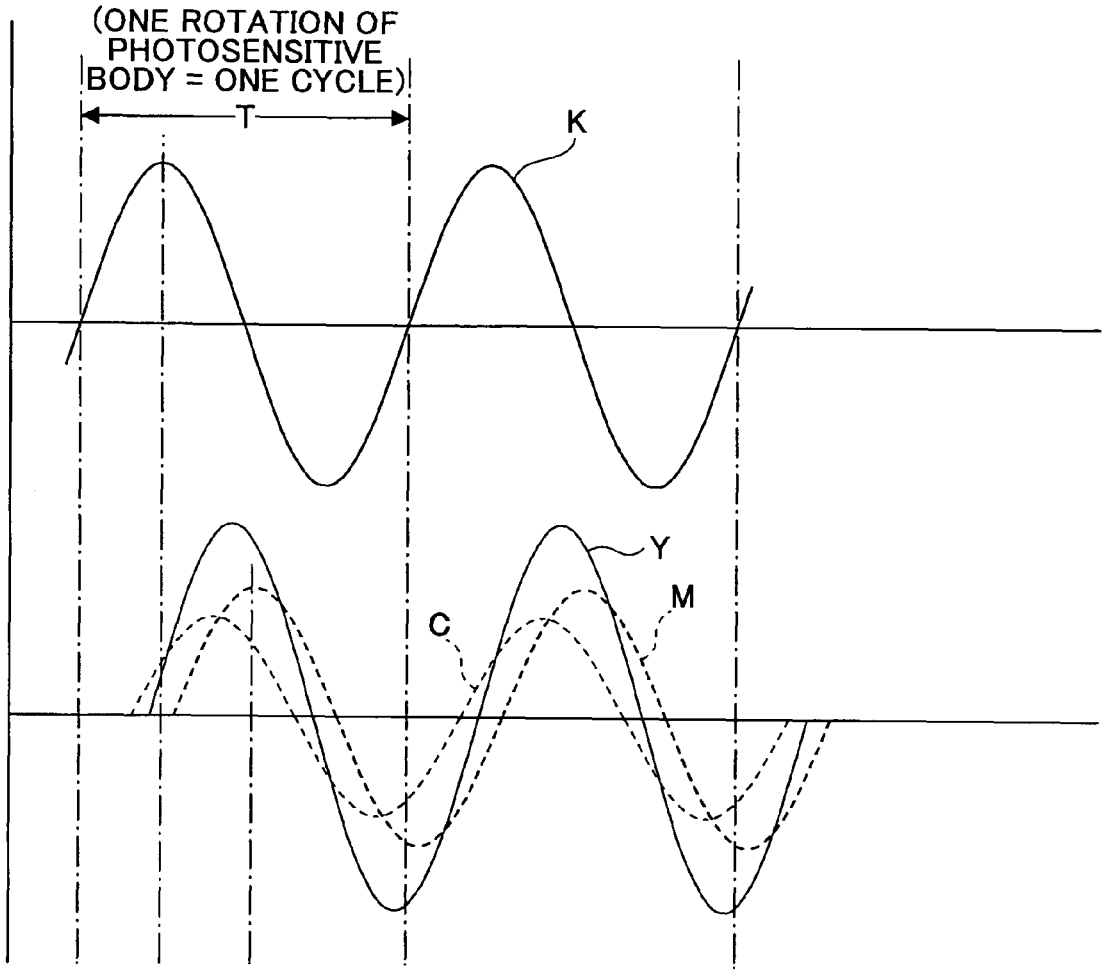
FIG. 15 is a graph showing the actual fluctuation waveforms of the photosensitive bodies for the respective colors in a printer according to a first specific example.
Figure 16:
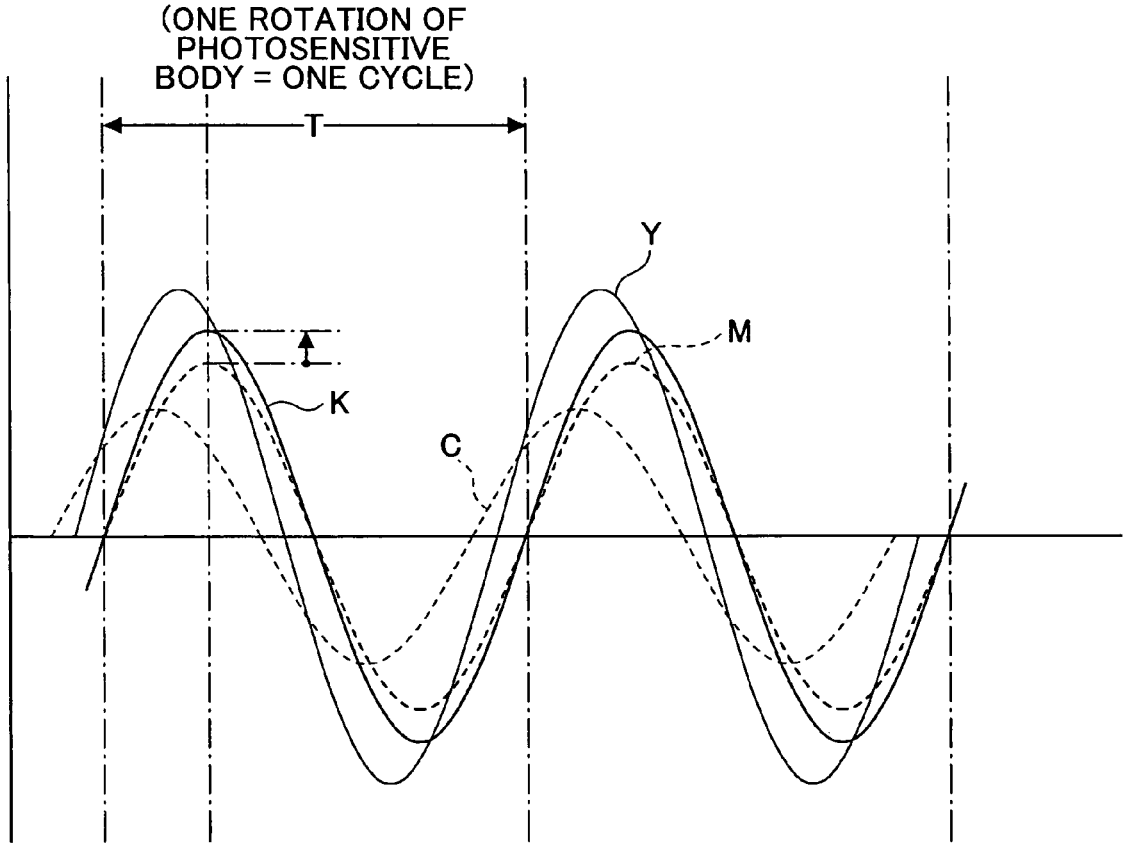
FIG. 16 is a graph showing the actual fluctuation waveforms of- the photosensitive bodies for the respective colors after the phases of the actual fluctuation waveforms are matched to each other.
Figure 17:
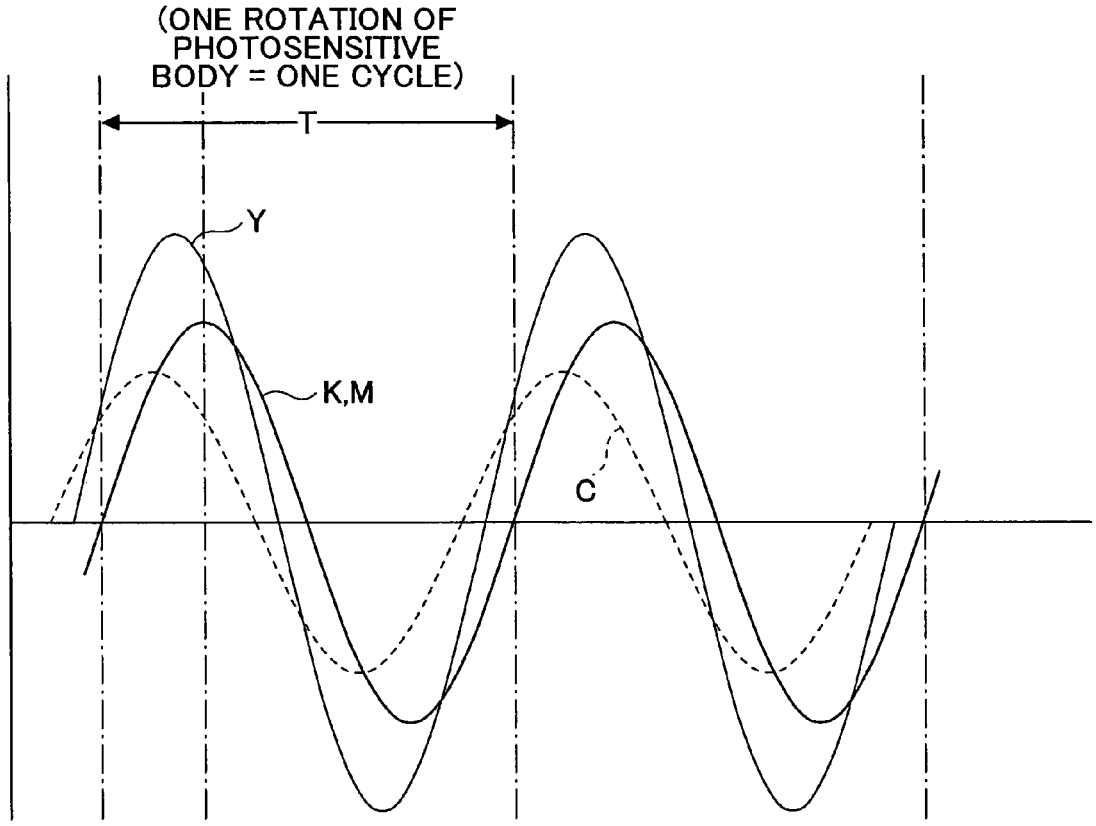
FIG. 17 is a graph showing the actual fluctuation waveforms of the photosensitive bodies for the respective colors when the driving speeds of the photosensitive bodies are adjusted.

FIG. 15 is a graph showing the actual fluctuation waveforms of the photosensitive bodies for the respective colors in the printer according to the first specific example. The three photosensitive bodies 1Y, 1M, and 1C among the four photosensitive bodies are assembled so as to make their photosensitive-body gears meshed with each other. A relationship between the phases of the actual fluctuation waveforms is constant regardless of the driving amount of the driving motor 90YMC as the shared driving source. In other words, the phases of the actual fluctuation waveforms of the photosensitive bodies 1Y, 1M, and 1C are displaced from each other as shown in FIG. 15, but this displacement relationship is constant regardless of the driving amount of the driving motor 90YMC. However, if any of the processing units for the respective colors is detached, the displacement relationship is changed. This is because when the processing unit is replaced with a new one or when a meshed state between the coupling on the side of the printer main body and that on the side of the photosensitive body is changed from a state before the processing unit is detached although the processing unit is not replaced, the actual fluctuation waveform of the photosensitive body of the processing unit is changed. Accordingly, when the control unit 150 detects the detachment operation of the processing unit, it performs the waveform acquisition processing for acquiring the changed actual fluctuation waveform of the photosensitive body of the processing unit. Note that since the actual fluctuation waveform of the color M is matched to that of the color K in the first specific example, the acquisition of the actual fluctuation waveforms of the two colors Y and C is not required. Therefore, as for the two colors Y and C, the control unit 150 does not store the data of the actual fluctuation waveforms nor perform the waveform acquisition processing even if it detects the detachment operations of the processing units. However, in order to understand a relationship with the actual fluctuation waveforms of these two colors, FIGS. 15, 16, and 17 show not only the actual fluctuation waveforms of the colors K and M but also those of the colors Y and C.

When the control unit 150 starts the color-mode print job to drive the driving motor 90K and the driving motor 90YMC, it recognizes the phase of the actual fluctuation waveform of the color K and that of the actual fluctuation waveform of the color M based on outputs from the gear sensor 91K and the gear sensor 91YMC. If the previous print job is a monochrome-mode print job, the phase of the actual fluctuation waveform of the color K is greatly displaced from that of the color M as shown in FIG. 15. Thus, the control unit 150 temporarily changes the driving amount of the driving motor 90YMC based on the outputs from the two gear sensors to match the phase of the actual fluctuation waveform of the color M to that of the actual fluctuation waveform of the color K. Note that in order to clearly show the synchronization of the phases of the colors K and M, FIG. 16 shows the actual fluctuation waveform of the color K in addition to those of the colors Y, M, and C on the same coordinate.

However, even if the phases are thus matched to each other, the corresponding actual fluctuation waveforms are not completely superimposed one on another. This is because the amplitudes of the actual fluctuation waveforms are different as shown in FIG. 16. In an example shown in FIG. 16, the amplitude of the actual fluctuation waveform of the color M is smaller than that of the actual fluctuation waveform of the color K. In this case, in order to match the amplitude of the actual fluctuation waveform of the color M to that of the actual fluctuation waveform of the color K, the driving speed of the driving motor 90YMC is finely adjusted to intentionally increase the speed fluctuation amount of the color M. Conversely, when the amplitude of the actual fluctuation amount of the color M is greater than that of the actual fluctuation waveform of the color K, the speed fluctuation amount of the color M is reduced to match the two actual fluctuation waveforms to each other. Then, the control unit 150 starts processing for finely adjusting the driving speed of the driving motor 90YMC at a predetermined pattern based on a driving speed pattern for the color M constructed in advance in accordance with a difference between the actual fluctuation waveform of the color K and that of the color M. Thus, as shown in FIG. 17, after matching the actual fluctuation waveforms of the colors K an M to each other, the control unit 150 starts optical writing processing on the photosensitive bodies 1Y, 1M, 1C, and 1K.

Second Specific Example

Recognition of a displacement of dots from the color K serving as the reference color using the color Y is the most difficult. However, if the displacement amount of the color Y is significant, the displacement between the colors K and Y is easily recognized. The printer according to a second specific example performs the following processing instead of performing the processing for matching the phase and amplitude of any one of the actual fluctuation waveforms of the three photosensitive bodies 1Y, 1M, and 1C that share the driving motor 90YMC to those of the actual fluctuation waveforms of the photosensitive body 1K. In other words, the printer performs the processing for matching the phase and amplitude of an actual fluctuation average waveform obtained by averaging the actual fluctuation waveforms of the three photosensitive bodies 1Y, 1M, and 1C to those of the actual fluctuation waveform of the photosensitive body 1K.

When the control unit detects the detachment operation of any one of the three photosensitive bodies 1Y, 1M, and 1C that share the driving motor 90YMC, it performs average waveform update processing for updating the actual fluctuation average waveform in addition to the waveform acquisition processing for acquiring the actual fluctuation waveform of the detached photosensitive body. This is because if any one of the actual fluctuation waveforms of the three photosensitive bodies 1Y, 1M, and 1C is changed, the actual fluctuation average waveform as an average of the three actual fluctuation waveforms is also changed. Therefore, when the control unit 150 detects the detachment operation of any of the photosensitive bodies 1Y, 1M, and 1C, it acquires the actual fluctuation waveform of the detached photosensitive body and updates the same. Then, the control unit determines the actual fluctuation average waveform obtained by averaging the actual fluctuation waveforms of the photosensitive bodies 1Y, 1M, and 1C based on the updated actual fluctuation waveform.

Figure 18:
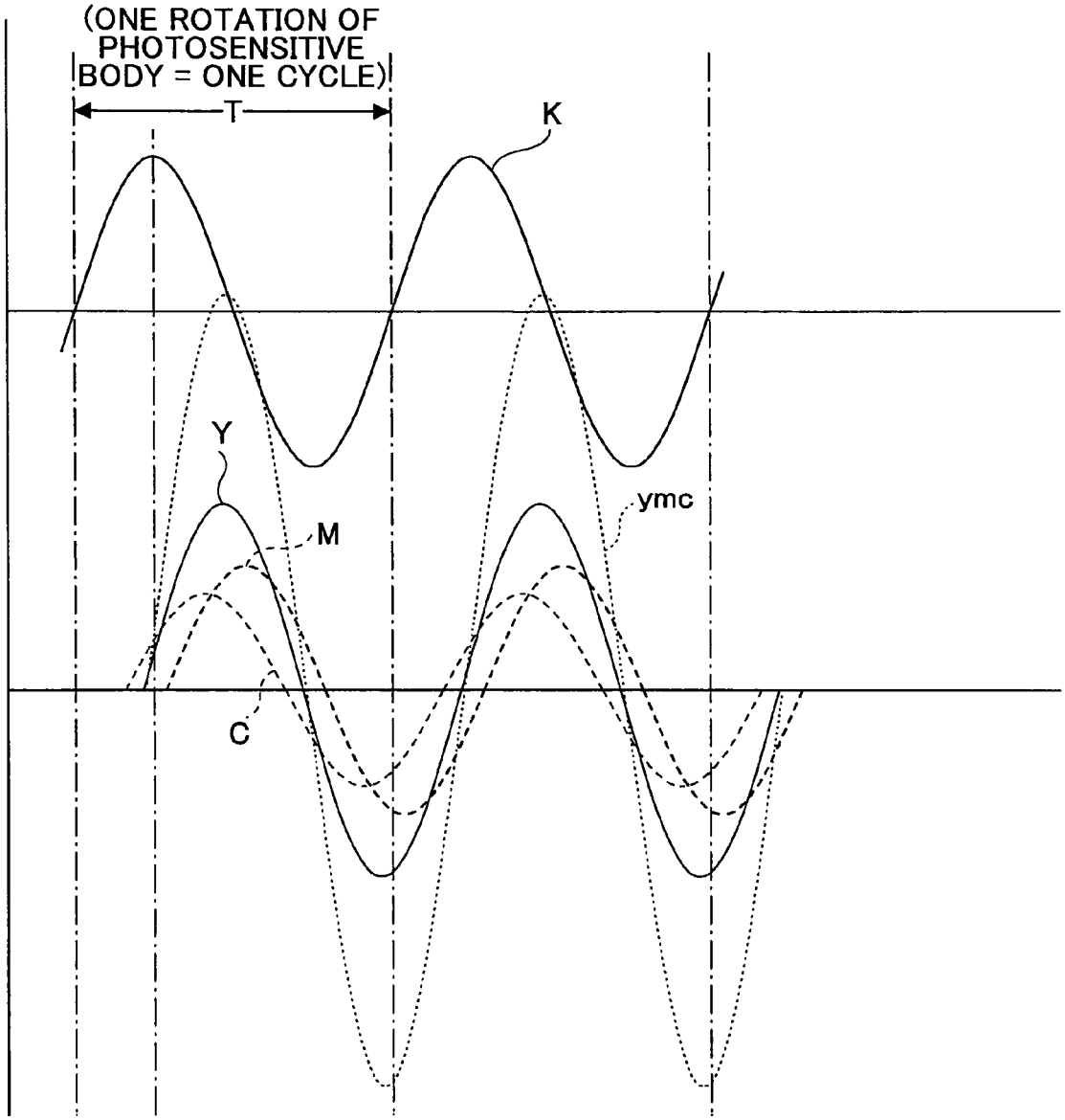
FIG. 18 is a graph showing a superimposed waveform together with the actual fluctuation waveforms of the photosensitive bodies for the respective colors in a printer according to a second specific example.
Figure 19:
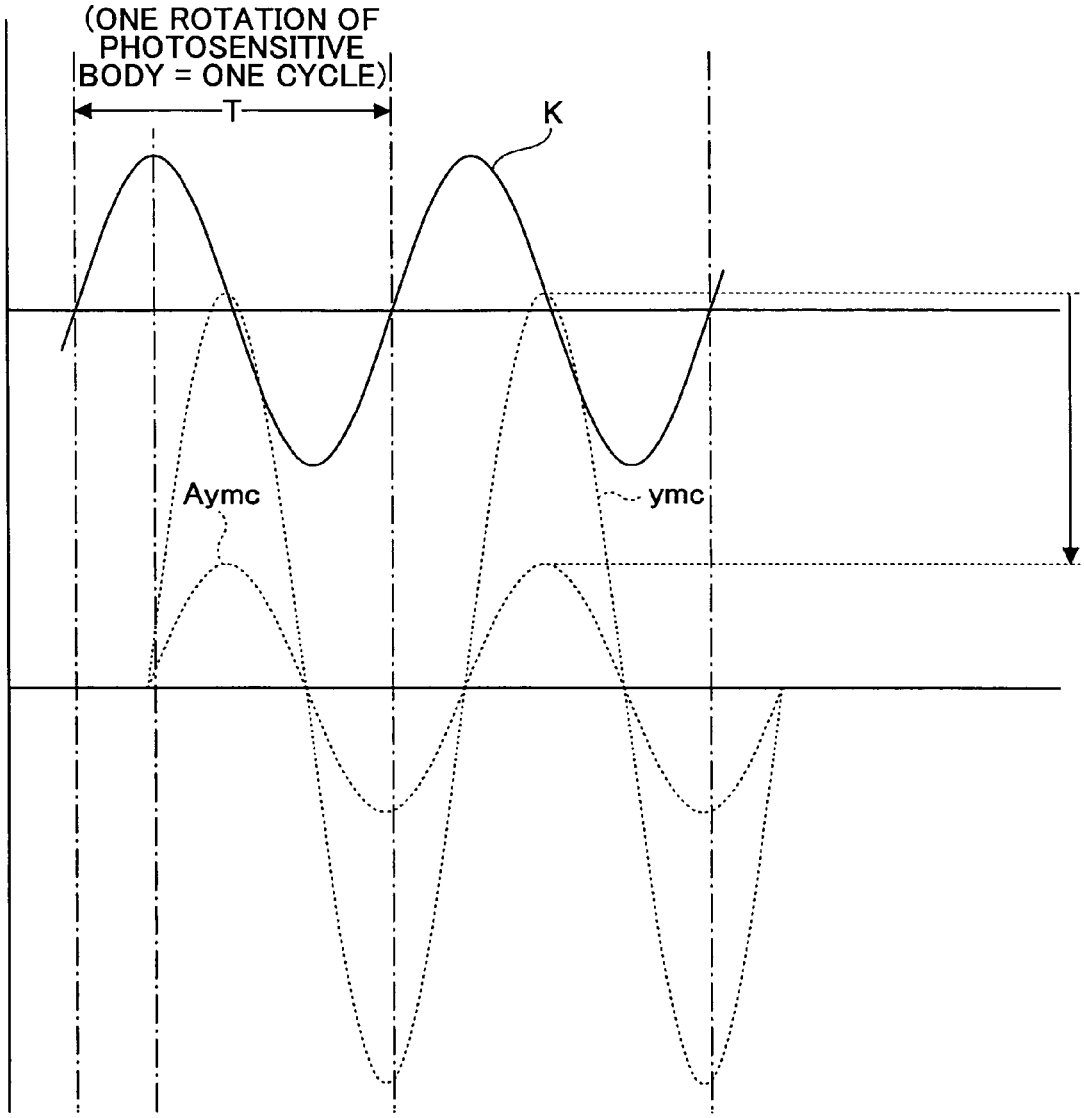
FIG. 19 is a graph showing the superimposed waveform, an actual fluctuation average waveform, and the actual fluctuation waveform for the color K.

FIG. 18 is a graph showing a superimposed waveform ymc for the colors Y, M, and C together with the actual fluctuation waveforms of the photosensitive bodies for the respective colors in the printer according to the second specific example. In FIG. 18, any of the actual fluctuation waveforms Y, M, and C of the three photosensitive bodies 1Y, 1M, and 1C that share the driving motor 90YMC is updated after the detachment operation. The control unit 150 determines the actual fluctuation average waveform based on the three actual fluctuation waveforms as follows. First, the control unit 150 first determines the superimposed waveform ymc where all the three actual fluctuation waveforms are superimposed one on another. Then, as shown in FIG. 19, the control unit 150 reduces the amplitude of the superimposed waveform ymc to one-third to be determined as an actual fluctuation average waveform Aymc and updates the data of the actual fluctuation average waveform stored in the data storage unit.

Figure 20:
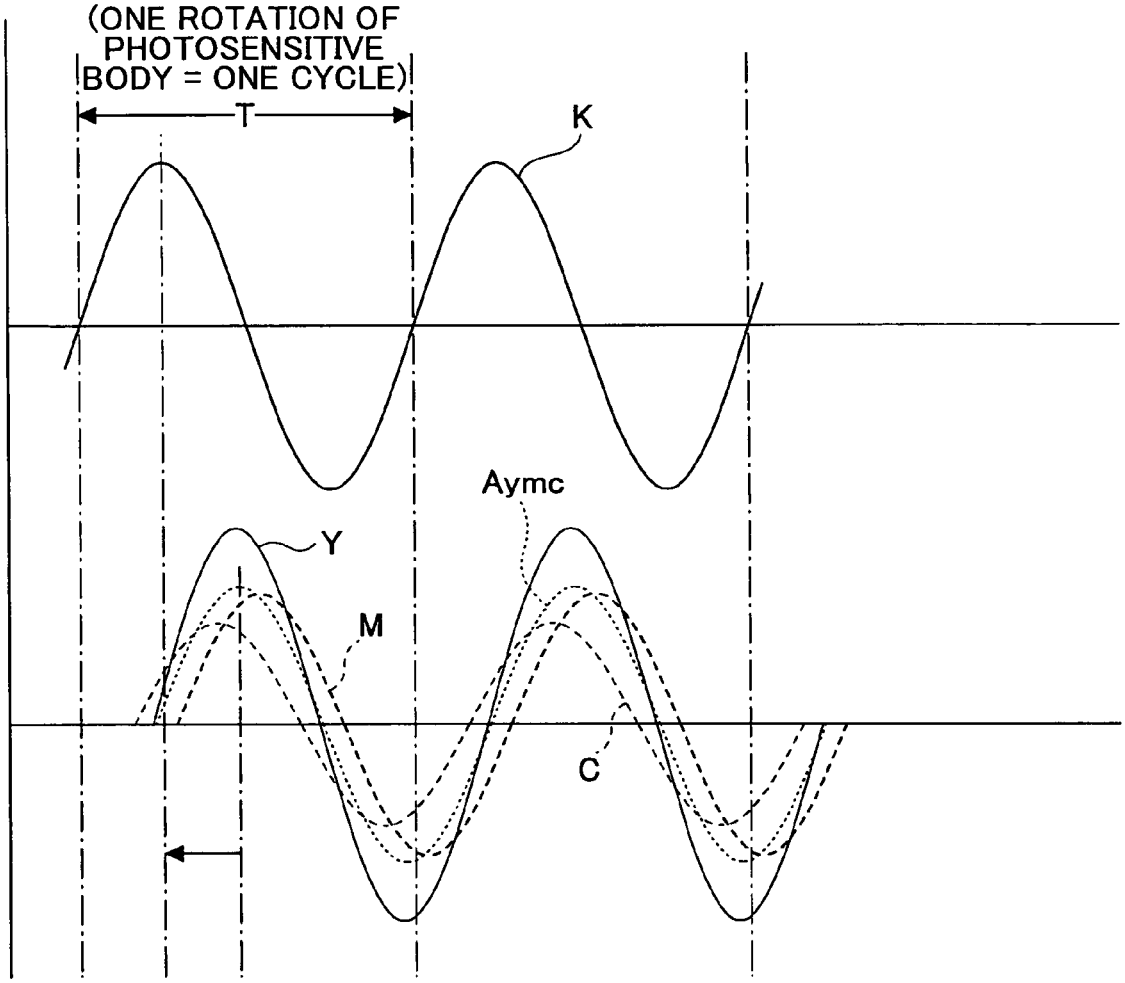
FIG. 20 is a graph showing the actual fluctuation waveforms of the respective colors and the actual average waveform.
Figure 21:
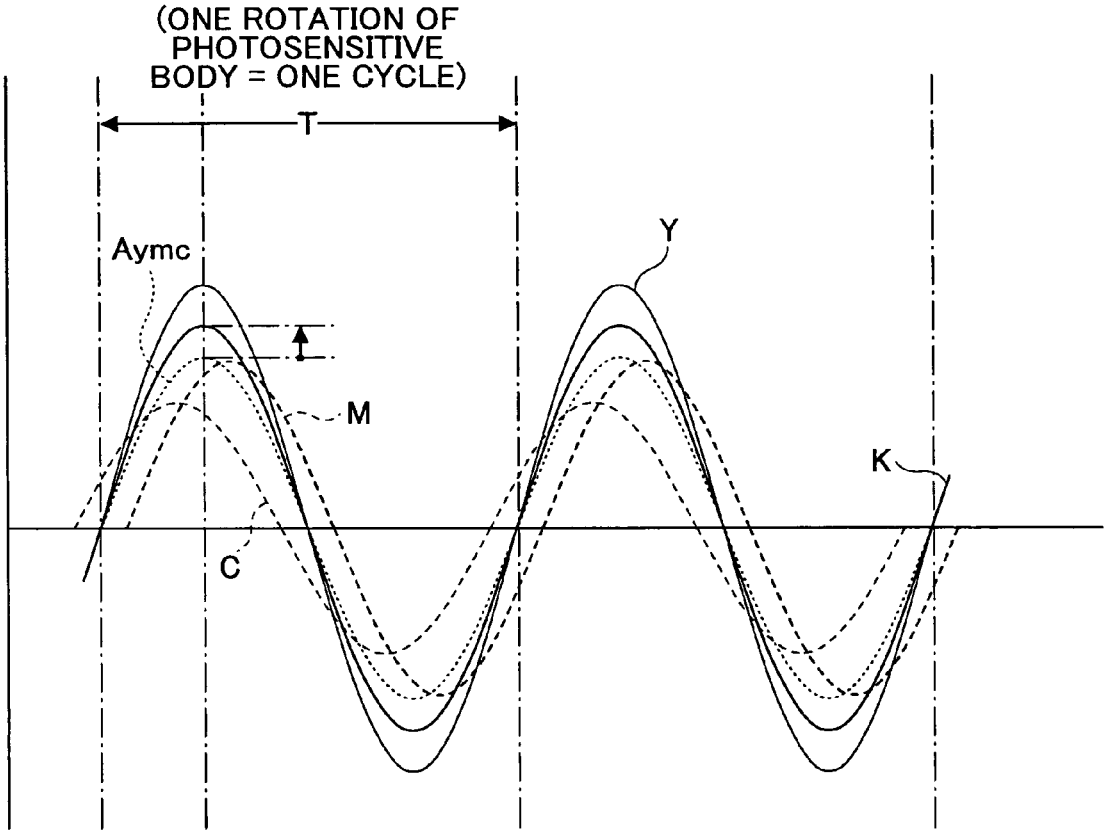
FIG. 21 is a graph showing the actual fluctuation waveforms of the respective colors and the actual fluctuation average waveform after the phases of the actual fluctuation waveforms of the respective colors and that of the actual fluctuation average waveform are matched -to each other.
Figure 22:
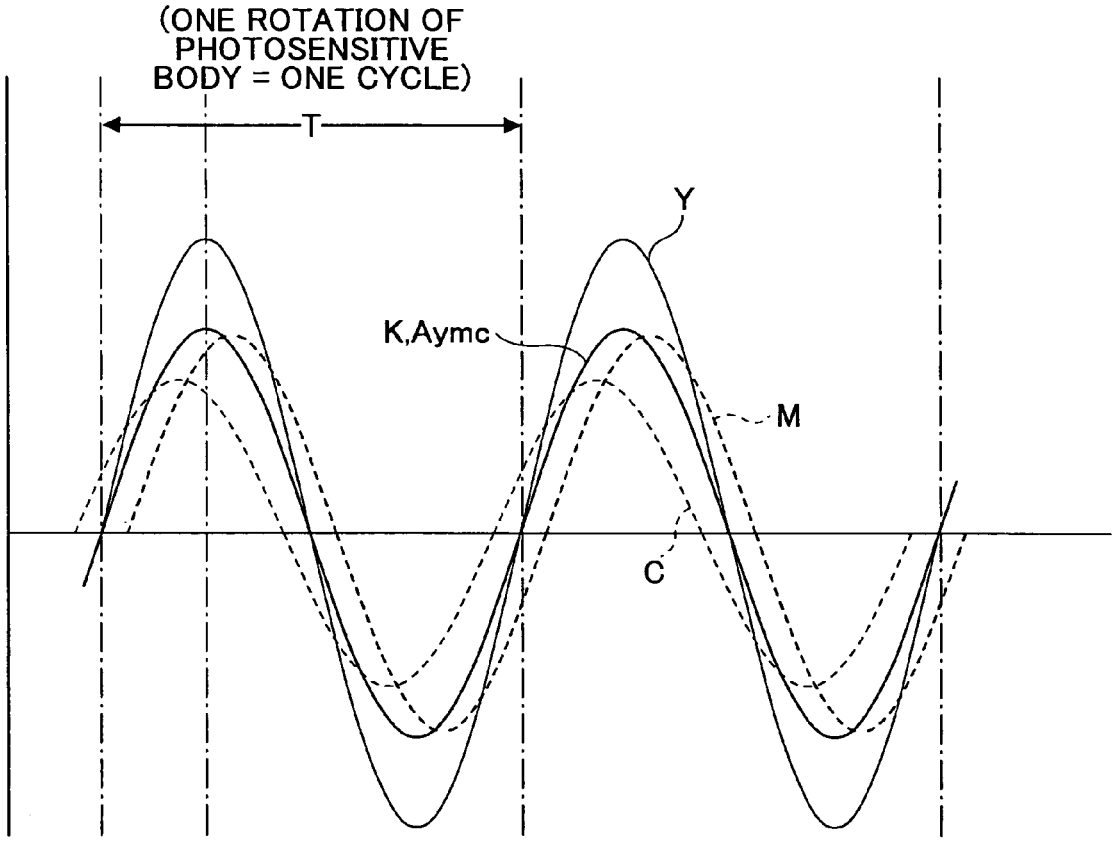
FIG. 22 is a graph showing the actual fluctuation waveforms of the photosensitive bodies for the respective colors when the driving speeds of the photosensitive bodies are adjusted.

When the control unit 150 drives the driving motor 90K and the driving motor 90YMC along with the starting of the color-mode print job, it recognizes the phase of the actual fluctuation waveform of the color K and that of the actual fluctuation average waveform Aymc based on outputs from the gear sensor. 91K and the gear sensor 91YMC. If the previous print job is a monochrome-mode print job, the phase of the actual fluctuation waveform of the color K is greatly displaced from that of the actual fluctuation average waveform Aymc as shown in FIG. 20. Thus, as shown in FIG. 21, the control unit 150 temporarily changes the driving amount of the driving motor 90YMC based on the outputs from the two gear sensors to match the phase of the actual fluctuation average waveform Aymc to that of the actual fluctuation waveform of the color K. Then, the control unit 150 starts processing for finely adjusting the driving speed of the driving motor 90YMC at a predetermined pattern based on a driving speed pattern for the colors Y, M, and C constructed in advance in accordance with a difference between the actual fluctuation waveform of the color K and the actual fluctuation average waveform Aymc. Thus, after almost matching the actual fluctuation waveform of the color K to the actual fluctuation average waveform Aymc as shown in FIG. 22, the control unit starts the optical writing processing on the photosensitive bodies 1Y, 1M, 1C, and 1K.

The above description refers to the printer in which the toner images on the photosensitive bodies 1Y, 1M, 1C, and 1K are transferred to the intermediate transfer belt 8 so as to be superimposed one on another. However, the present invention can also be applied to the following image forming apparatus. In other words, the present invention can be applied to an image forming apparatus in which toner images on plural photosensitive bodies are transferred to the front surface of the recording paper, which is held and conveyed on the front surface of the endless movement body such as the belt member that performs the endless movement, so as to be superimposed one on another.

As described above, the printer according to the first specific example has the control unit 150 that uses the driving motor 90YMC, which serves as a second driving source, also as the driving source for the two or more photosensitive bodies 1Y, 1M, and 1C and constitutes the waveform recognition unit for recognizing the actual fluctuation waveform of the specified photosensitive body 1M as the second waveform. The control unit 150 performs the processing for matching the phase and amplitude of the photosensitive body 1M to those of the photosensitive body 1K. With this configuration, the displacement in the superimposition of the dots of the colors K and M can be kept at a tolerance level.

Furthermore, the printer according to the second specific example has the control unit that performs the processing for matching the phase and amplitude of the actual fluctuation average waveform Aymc obtained by averaging the three actual fluctuation waveforms of the colors Y, M, and C to those of the actual fluctuation waveform of the color K instead of performing the processing for matching the phase and amplitude of any of the actual fluctuation waveforms of the three photosensitive bodies 1Y, 1M, and 1C to those of the actual fluctuation waveform of the color K. With this configuration, the displacements in the superimposition of the dots of the colors Y, M, and C and the dot of the color K can be prevented.

According to the present invention, with the shared use of the first driving source between any one of the plural image carriers and the members other than the image carriers and the driving transmission unit for driving the image carriers, manufacturing costs can be reduced.

Furthermore, the driving of the first and second driving sources is controlled so that the phase of the second waveform as the speed fluctuation waveform occurring when the image carrier to be driven by the second driving source is driven by the second driving source at a predetermined speed is matched to that of the first waveform as the speed fluctuation waveform occurring when the image carrier to be driven by the first driving source is driven by the first driving source at a predetermined speed. At this time, if only the phases of the first and second waveforms are matched to each other, displacements in the superimposition corresponding to a difference between the amplitudes of the first and second waveforms remain. Therefore, not only the phases but also the amplitudes of the first and second waveforms are matched to each other. Thus, the displacement in the superimposition corresponding to the difference between the amplitudes of the first and second waveforms is almost eliminated. Specifically, when the amplitude of the second waveform is greater than that of the first waveform, the driving speed of the second driving source is adjusted so that the amplitude of the second waveform is made smaller to be equal to the amplitude of the first waveform. On the other hand, when the amplitude of the second waveform is smaller than that of the first waveform, the driving speed of the second driving source is adjusted so that the amplitude of the second waveform is made greater to be equal to the amplitude of the first waveform. When the amplitude of the second waveform is made equal to that of the first waveform in a state in which the phase of the second waveform is matched to that of the first waveform, the difference between the amplitudes of the first and second waveforms is almost eliminated. Thus, the displacement in the superimposition corresponding to the difference can be almost eliminated. As a result, the displacement in the superimposition of the dots can be kept at a tolerance level.

The present invention is not limited to the specifically disclosed embodiments, and variations and modifications may be made without departing from the scope of the present invention.

The present application is based on Japanese Priority Application No. 2008-164970 filed on Jun. 24, 2008, the entire contents of which are hereby incorporated herein by reference.

What is claimed is:

1. An image forming apparatus comprising:

plural image carriers each having a visible image carried on a rotating surface thereof;

a first driving source that is a driving source for only any one of the image carriers;

a second driving source that is a driving source for another image carrier;

a rotation detection unit that separately detects whether the image carrier driven by the first driving source and another image carrier driven by the second driving source have a predetermined rotational angle;

an endless movement body that causes a front surface thereof to be endlessly moved;

a transfer unit that transfers the visible images formed on front surfaces of the image carriers to the front surface of the endless movement body or a recording member held on the front surface of the endless movement body so as to be superimposed one on another; and a control unit that controls driving of the first and second driving sources based on an output from the rotation detection unit, the image forming apparatus using the first driving source as a shared driving source between the image carrier and a predetermined member other than a driving transmission unit for driving the image carrier; wherein a waveform recognition unit is provided that recognizes a first waveform as a waveform of a first speed fluctuation and a second waveform as a waveform of a second speed fluctuation based on a result obtained by detecting the first speed fluctuation per rotation of the image carrier driven by a driving force of the first driving source driven at a predetermined speed and the second speed fluctuation per rotation of another image carrier driven by a driving force of the second driving source driven at a predetermined speed, and the control unit is configured to recognize a reference timing per rotation of the image carrier driven by the first driving source and a reference timing per rotation of another image carrier driven by the second driving source based on the output from the rotation detection unit and control the driving of the second driving source based on the reference timings and the first and second waveforms recognized by the waveform recognition unit, thereby matching a phase and an amplitude of the second waveform of another image carrier driven by the second driving source to a phase and an amplitude of the first waveform of the image carrier driven by the driving force of the first driving source driven at the predetermined speed.

2. The image forming apparatus according to claim 1, wherein the waveform recognition unit is configured to use the second driving source as the shared driving source between two or more of the image carriers and recognize a speed fluctuation waveform of at least a specified one of the two or more of the image carriers as the second waveform, and the control unit is configured to perform processing for matching the phase and the amplitude of the second waveform of the specified image carrier to the phase and the amplitude of the first waveform.

3. The image forming apparatus according to claim 1, wherein the waveform recognition unit is configured to use the second driving source as the shared driving source between two or more of the image carriers and recognize a speed fluctuation waveform per rotation of each of the two or more of the image carriers as the second waveform, and the control unit is configured to perform processing for matching a phase and an amplitude of an average waveform obtained by averaging the phases and the amplitudes of the plural second waveforms recognized by the waveform recognition unit to the phase and the amplitude of the first waveform instead of performing the processing for matching the phases and the amplitudes of the second waveforms to the phase and the amplitude of the first waveform.

4. The image forming apparatus according to claim 1, wherein the plural image carriers have the visible images of different colors carried thereon, the image carrier having the visible image of black carried thereon is driven by the first driving source, and the endless movement body is used as the predetermined member driven by the first driving source.

5. The image forming apparatus according to claim 1, wherein each of the plural image carriers has an image carrier gear that receives the driving force from the first driving source or the second driving source on a rotary shaft line of a rotary shaft member thereof and transmits the driving force to the image carrier while rotating and a coupling unit that couples the rotary shaft member with the image carrier gear on the rotary shaft line, and each of the plural image carriers is capable of being detached from an image forming apparatus main body with the image carrier gear remaining on a side of the image forming apparatus main body by releasing coupling by the coupling unit.

6. The image forming apparatus according to claim 5, wherein a detachment detection unit is provided that separately detects detachment operations of the plural image carriers from the image forming apparatus main body, the waveform recognition unit is configured to recognize a speed fluctuation waveform of the detached image carrier as the first waveform or the second waveform and store the speed fluctuation waveform in a data storage unit when the detachment operation of any of the image carriers is detected by the detachment detection unit, and the control unit is configured to control the driving of the first and second driving sources based on data of the first and second waveforms stored in the data storage unit and the output from the rotation detection unit.

7. An image forming method comprising:

a step of driving only any one of plural image carriers each having a visible image carried on a rotating surface thereof by a first driving source;

a step of driving two or more of the image carriers by a second driving source;

a rotation detection step of separately detecting whether the image carrier driven by the first driving source and the image carriers driven by the second driving source have a predetermined rotational angle;

a transfer step of transferring the visible images formed on front surfaces of the image carriers to an endlessly-moving front surface of an endless movement body or a recording member held on the endlessly-moving front surface of the endless movement body; and a control step of controlling driving of the first and second driving sources based on a detection result by the rotation detection step, the image forming method causing the first driving source to be used as a shared driving source between the image carrier and a predetermined member other than a driving transmission unit for driving the image carrier; wherein a waveform recognition step is provided that recognizes a first waveform as a waveform of a first speed fluctuation and second waveforms as waveforms of second speed fluctuations based on a result obtained by detecting the first speed fluctuation per rotation of the image carrier driven by a driving force of the first driving source driven at a predetermined speed and the second speed fluctuations per rotation of the image carriers driven by a driving force of the second driving source driven at a predetermined speed, and the control step recognizes a reference timing per rotation of the image carrier driven by the first driving source and reference timings per rotation of the image carriers driven by the second driving source based on the detection result by the rotation detection step and controls the driving of the second driving source based on the reference timings and a recognition result by the waveform recognition step, thereby matching phases and amplitudes of the second waveforms of the image carriers driven by the second driving source to a phase and an amplitude of the first waveform of the image carrier driven by the driving force of the first driving source driven at the predetermined speed.

* * * * *